US008556376B2

(12) United States Patent
Kikkawa et al.

(10) Patent No.: US 8,556,376 B2
(45) Date of Patent: Oct. 15, 2013

(54) IMAGE FORMING APPARATUS

(75) Inventors: Fumitaka Kikkawa, Kanagawa (JP); Yoichi Ito, Tokyo (JP); Tomomi Katoh, Kanagawa (JP); Mitsuya Matsubara, Kanagawa (JP); Kuniyori Takano, Kanagawa (JP); Soyoung Park, Kanagawa (JP); Honriku Jo, Kanagawa (JP); Satoshi Endoh, Saitama (JP); Yuji Tanaka, Kanagawa (JP); Akiyoshi Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/297,677

(22) Filed: Nov. 16, 2011

(65) Prior Publication Data

US 2012/0133707 A1 May 31, 2012

(30) Foreign Application Priority Data

Nov. 25, 2010 (JP) ..... 2010-262972

(51) Int. Cl.
*B41J 2/165* (2006.01)

(52) U.S. Cl.
USPC ..... 347/30

(58) Field of Classification Search
None
See application file for complete search history.

(56) References Cited

U.S. PATENT DOCUMENTS

| | | | | |
|---|---|---|---|---|
| 5,055,856 | A * | 10/1991 | Tomii et al. | 347/30 |
| 7,182,426 | B2 | 2/2007 | Takahashi et al. | |
| 2008/0143778 | A1* | 6/2008 | Sugiyama et al. | 347/23 |
| 2010/0026758 | A1 | 2/2010 | Tanaka et al. | |
| 2010/0045733 | A1* | 2/2010 | Mano | 347/29 |
| 2010/0061745 | A1 | 3/2010 | Ito et al. | |
| 2010/0207990 | A1 | 8/2010 | Ito et al. | |
| 2011/0109692 | A1 | 5/2011 | Ito et al. | |
| 2011/0141167 | A1 | 6/2011 | Kikkawa et al. | |
| 2011/0141181 | A1 | 6/2011 | Ito et al. | |

FOREIGN PATENT DOCUMENTS

| | | |
|---|---|---|
| JP | 3589238 | 8/2004 |
| JP | 4186557 | 9/2008 |

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

Disclosed is an image forming apparatus including a recording head; a cap member capping the nozzle surface of the recording head and including a release port and a suction port; a suction unit in communication with the suction port; a switch unit opening and closing the release port to the air and capable of adjusting the opening amount of the release port to at least a first opening amount and a second opening amount larger than the first opening amount; and a control unit that controls the suction unit and the switch unit so that the release port is opened to the first opening amount to have a predetermined amount of air flow into the cap member after the cap member is suctioned by the suction unit, and the release port is then opened to the second opening amount.

3 Claims, 16 Drawing Sheets

IMAGE FORMING APPARATUS

BACKGROUND OF THE INVENTION

1. Field of the Invention

The present invention relates to an image forming apparatus and more specifically, to an image forming apparatus including a recording head discharging droplets.

2. Description of the Related Art

The ink-jet recording apparatus and the like are known as an image forming apparatus of a liquid discharging recording type, such as a printer, a facsimile, a copier, a plotter, a multifunction device of them, and the like, using, for example, a recording head that discharges ink droplets. In the image forming apparatus of this liquid discharging recording type, ink droplets are discharged from a recording head to a conveyed paper to form an image (record, type, develop, and print are also used as synonyms.) on the paper. This type includes a serial type image forming apparatus in which droplets are discharged from the recording head with the recording head being moved along a main scanning direction to form an image, and a line type image forming apparatus in which droplets are discharged from a line type recording head that is not moved while forming an image.

Here, in this application, the term "the image forming apparatus" includes an apparatus by which image formation is performed by providing ink on a medium such as a paper, a thread, a fiber, a textile, a leather, a plastic, a glass, a wood material, ceramics, and the like.

Further in this application, the term "the image formation" includes forming a meaningless image such as a pattern or the like on the medium, in other words just providing ink on the medium, in addition to forming an image with some meaning such as characters, drawings and the like on the medium.

Further in this application, the term "the ink" or "the droplet" is used as a generic of liquid capable of forming an image such as recording liquid, fixing treatment liquid, solution, resin, or the like in addition to liquid or a droplet so called as ink.

Further in this application, the term "paper" is used as a generic of material on which an ink droplet is attached and includes the medium mentioned above such as an OHP (overhead projector) sheet, a textile or a cloth, or the like in addition to a typical paper.

Further, the term "an image" includes a three-dimensional image such as an image formed on a three-dimensional body or a stereoscopically formed image of a three-dimensional body in addition to a plane image.

Among the image forming apparatuses of the liquid discharging recording type, there is an apparatus that includes a maintenance and recovery mechanism including a cap member for capping or covering a nozzle surface of a recording head, a wiper member (called also as a wiper blade, a wiping blade, blade and the like) for wiping the nozzle surface of the recording head to clean the surface, and the like. In this apparatus, the maintenance and recovery mechanism performs a recovery operation of wiping the nozzle surface by the wiper member to form a nozzle meniscus after thickened ink is discharged into the cap member.

With this structure, ink is stably discharged from the nozzle of the recording head, evaporation of ink from inside of the nozzle can be prevented, and contamination of the nozzle by dust can be prevented.

Japanese Patent No. 3589238 discloses such the mechanism. Japanese Patent No. 4186557 also discloses a maintenance and recovery mechanism that includes a cap for capping a vertically positioned nozzle surface of a recording head, a release port capable of being open to the air, a suction port, a tube pump connected to the suction port, and a switch valve for opening and closing the release port to the air.

According to this technique, before releasing the cap member after suctioning the vertically positioned nozzle surface of the recording head capped by the cap member by the tube pump, the release port is opened to the air by the switch valve. Then, the liquid pulled down by a force of gravity and gathered at the bottom of the cap member is suctioned by the tube pump. Thereafter, the cap member is released.

However, when the release port is opened to the air after the cap member is suctioned by the pump, because of the air flushed into the cap member, the inside pressure of the cap member becomes drastically high to cause a pressure overshoot. As a result, the liquid gathered at the bottom of the cap member is scattered out of the cap member via the release port and the switch unit. Especially when the pump that blocks the flow of the liquid exhausted from the cap member such as a tube pump is used, this type of problem easily occurs.

SUMMARY OF THE INVENTION

The present invention is made in light of the above problems, and may provide an image forming apparatus including a maintenance and recovery mechanism by which liquid is not scattered out from the cap member even when the cap member is opened to the air after being suctioned by a suction unit.

The present invention has been made based on the knowledge the inventors have thus obtained and has the following configurations.

According to an embodiment, there is provided an image forming apparatus including: a recording head that includes a nozzle surface on which a line of nozzles is provided where plural of the nozzles are aligned, each of the plural nozzles discharging a droplet; a cap member that caps the nozzle surface of the recording head and includes a release port capable of being open to the air and a suction port; a suction unit that is provided to be in communication with the suction port of the cap member to suction a liquid in the nozzles of the recording head; a switch unit that opens and closes the release port of the cap member to the air, the switch unit being capable of adjusting the opening amount of the release port to at least a first opening amount and a second opening amount larger than the first opening amount; and a control unit that controls the suction unit and the switch unit so that the liquid in the nozzles of the recording head is suctioned by the suction unit from the suction port, the release port is then opened to the first opening amount to have a predetermined amount of the air flow into the cap member, and the release port is opened to the second opening amount after the predetermined amount of the air flows into the cap member.

According to another embodiment, there is provided an image forming apparatus including a recording head that includes a nozzle surface on which a line of nozzles is provided where plural of the nozzles are aligned, each of the plurality of nozzles discharging a droplet; a cap member that caps the nozzle surface of the recording head and includes a release port capable of being open to the air and a suction port; a suction unit that is provided to be in communication with the suction port of the cap member to suction a liquid in the nozzles of the recording head; a switch unit that is provided to be in communication with the release port of the cap member to open and close the release port of the cap member to the air; and a transformable flexible film that is provided to compose at least a part between the suction port of the cap member and the switch unit and is capable of forming a concavity inside when the cap member is suctioned by the suction unit and expanding outward when the release port of the cap member is released to the air after the operation of the suction unit is terminated.

According to another embodiment, there is provided an image forming apparatus including a recording head that includes a nozzle surface on which a line of nozzles is provided where plural of the nozzles are aligned, each of the plural nozzles discharging a droplet; a cap member that caps the nozzle surface of the recording head and includes a release port capable of being open to the air and a suction port; a suction unit that is provided to be in communication with the suction port of the cap member to suction a liquid in the nozzles of the recording head; a switch unit that opens and closes the release port of the cap member to the air; and a pressure recovery delay mechanism that delays the recovery of the pressure in the cap member after the pressure in the cap member is lowered by being suctioned by the suction unit and then released to the air by operating the switch unit to open the release port of the cap member to the air.

According to another embodiment, there is provided an image forming apparatus including a recording head that includes a nozzle surface on which a line of nozzles is provided where plural of the nozzles are aligned, each of the plural nozzles discharging a droplet; a cap member that caps the nozzle surface of the recording head and includes a release port capable of being open to the air and a suction port; a suction unit that is provided to be in communication with the suction port of the cap member to suction a liquid in the nozzles of the recording head; and a switch unit that is provided to be in communication with the release port of the cap member to open and close the release port of the cap member to the air; a bypass channel that is provided to be in communication with the suction port of the cap member and bypasses the suction unit to be opened to the air; and a block unit that changes the flow from the suction port of the cap member between a direction toward the suction unit and a direction toward the bypass channel.

According to another embodiment, there is provided an image forming apparatus including a recording head that includes a nozzle surface on which a line of nozzles is provided where plural of the nozzles are aligned, each of the plural nozzles discharging a droplet; a cap member that caps the nozzle surface of the recording head and includes a release port capable of open to the air and a suction port; a suction unit that is provided to be in communication with the suction port of the cap member to suction a liquid in the nozzles of the recording head, the suction unit being a tube pump including a rotating member, an elastic tube being in communication with the suction port of the cap member and a roller provided along the outer periphery of the rotating member to press the elastic tube; a switch unit that is provided to be in communication with the release port of the cap member to open and close the release port of the cap member to the air; and a control unit that controls the position of the rotating member of the tube pump so that the elastic tube is not pressed by the roller when the switch unit opens the release port to the air.

According to another embodiment, there is provided an image forming apparatus including a recording head that includes a nozzle surface on which a line of nozzles is provided where plural of the nozzles are aligned, each of the plural nozzles discharging a droplet; a cap member that caps the nozzle surface of the recording head and includes a release port capable of open to the air and a suction port; a suction unit that is provided to be in communication with the suction port of the cap member to suction a liquid in the nozzles of the recording head; a switch unit that is provided to be in communication with the release port of the cap member to open and close the release port of the cap member to the air; and a check valve that is provided at the release port or a position between the release port and the switch unit, the check valve only permitting flow from outside to the release port and blocking flow towards outside.

According to another embodiment, there is provided an image forming apparatus including a recording head that includes a nozzle surface on which a line of nozzles is provided where plural of the nozzles are aligned, each of the plural nozzles discharging a droplet; a cap member that caps the nozzle surface of the recording head and includes a suction port, a release port, and a third port, the release port and the third port being capable of being open to the air; a suction unit that is provided to be in communication with the suction port of the cap member to suction a liquid in the nozzles of the recording head; and a switch unit that is provided to be in communication with the release port of the cap member to open and close the release port of the cap member to the air.

The above image forming apparatus may further include a check valve that only permits flow toward outside from the third port of the cap member.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
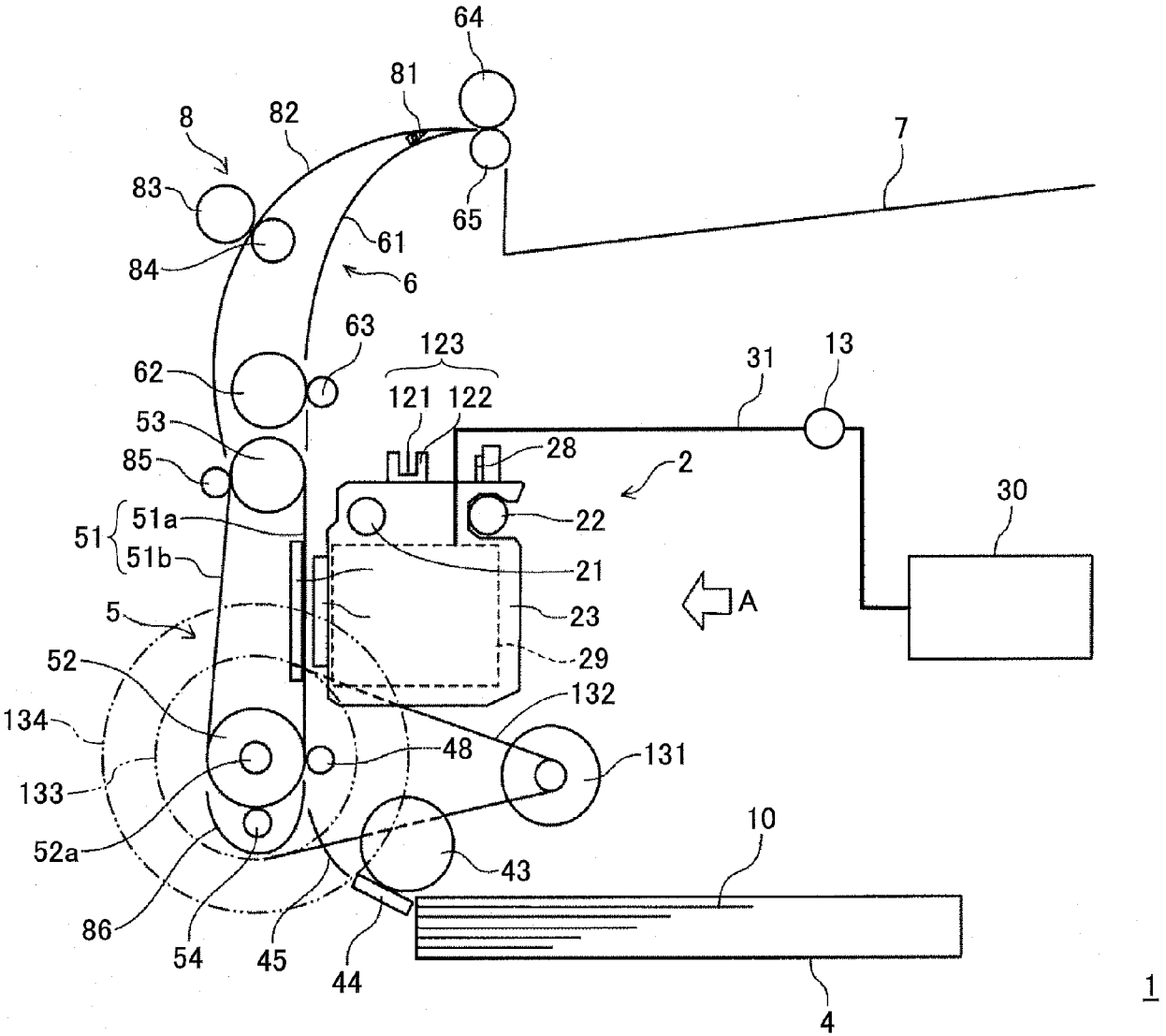
FIG. 1 is a side view of the mechanical part of the image forming apparatus according to an embodiment.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Next, embodiments of the present invention will be described below with reference to drawings.

It is to be noted that, in the explanation of the drawings, the same components are given with the same reference numerals, and explanations are not repeated.

First Embodiment

Figure 2:
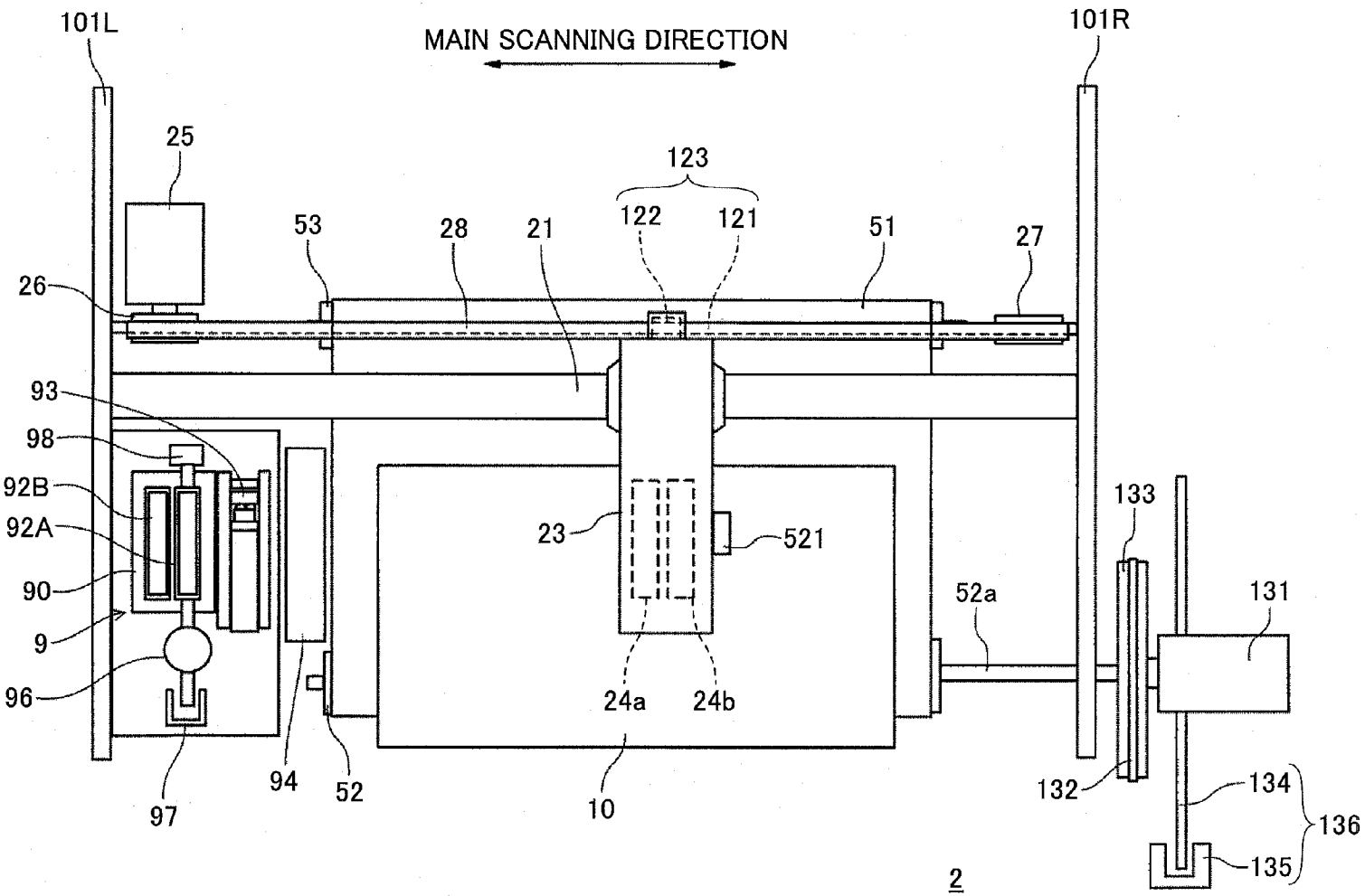
FIG. 2 is a diagram exemplary showing the mechanical part of the image forming apparatus seen from the arrow A direction of FIG. 1.

FIGS. 1 and 2 respectively show the structure of an image forming apparatus 1 of the present embodiment. FIG. 1 is a side view of the mechanical part of the image forming apparatus 1. FIG. 2 is an exemplary diagram showing the mechanical part of the image forming apparatus 1 seen from the arrow A direction of FIG. 1.

In the following embodiment, the image forming apparatus 1 may be a serial-type image forming apparatus.

The image forming apparatus 1 includes an image forming unit 2, a conveying mechanism 5, and the like inside its main body. The image forming apparatus 1 further includes a paper-feed tray 4 (or a paper-feed unit including a paper-feed cassette) provided at the lower side of its main body, a paper ejecting unit 6, a reverse unit 8, and a paper-catch tray 7 provided at the upper side of its main body.

In the image forming apparatus 1, the conveying mechanism 5 receives a paper 10 fed from the paper-feed tray 4 and intermittently conveys the paper 10 in the vertical direction (along the upright direction). While the conveying mechanism 5 intermittently conveys the paper 10 in the vertical direction, the image forming unit 2 discharges liquid droplets in the horizontal direction to form a certain image on the paper 10. After that, the conveying mechanism 5 further conveys the paper 10 on which the image is formed upward through the paper ejecting unit 6 so that the paper 10 is fed on to the paper-catch tray 7.

In order to perform duplex printing, after an image is formed on one side of the paper 10, the paper is fed to the reverse unit 8 from the paper ejecting unit 6. Then, the reverse unit 8 reverses the paper 10 so that an image can be formed on the other side of the paper 10 while the conveying mechanism 5 conveys the paper 10 oppositely (downward). Then, the conveying mechanism 5 conveys the paper 10 upward again while the image forming unit 2 forms an image on the other side of the paper 10. After the image is formed on the other side of the paper 10, the paper 10 is fed on to the paper-catch tray 7.

Referring to FIG. 2, the image forming unit 2 slidably holds a carriage 23 on which a recording head 24 (24*a* and/or 24*b*) is mounted by a main guide member 21 and a sub guide member 22 (see FIG. 1) horizontally provided between side boards 101L and 101R provided on left and right sides, respectively. The image forming unit 2 moves the carriage 23 in a main scanning direction by a main scanning motor 25 through a timing belt 28 provided between a drive pulley 26 and a driven pulley 27.

The carriage 23 includes the recording heads 24 a and 24*b* (simply referred to as "recording head 24" as described above when it is unnecessary to distinguish them). The recording heads 24*a* and 24*b* are composed of liquid discharging heads discharging ink droplets of colors including yellow (Y), magenta (M), cyan (C), and black (K).

Figure 3:
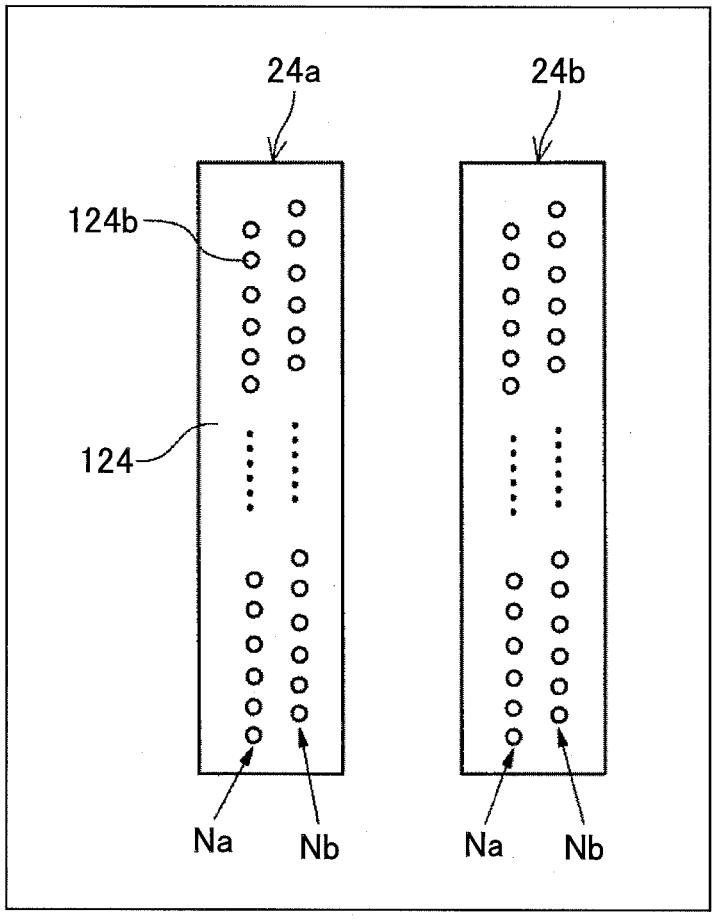
FIG. 3 is a drawing showing a detailed structure of the recording heads according to the embodiment.

FIG. 3 shows a detailed structure of the recording heads 24*a* and 24*b*. As shown in FIG. 3, the recording heads 24*a* and 24*b* respectively include a nozzle surface 124 on which lines of nozzles are provided where the plural nozzles 124*b* each discharging droplets are aligned. In this case, two lines of nozzles Na and Nb are provided on the nozzle surface 124 of each of the recording heads 24*a* and 24*b*. The lines of nozzles Na and Nb of the recording head 24*a* discharge yellow (Y) droplets and magenta (M) droplets, respectively. The lines of nozzles Na and Nb of the recording head 24*b* discharge black (K) droplets and cyan (C) droplets, respectively.

In each of the lines of nozzles Na and Nb, the nozzles 124*b* are aligned in the sub scanning direction, which is perpendicular to the main scanning direction (shown in FIG. 2). In this example, the recording head 24 is provided to have droplets discharged in the horizontal direction. In other words, in this example, the image forming unit 2 adopts a horizontal discharging system including the recording head 24 where the nozzle surfaces 124 on which the nozzles 124*b* are formed are placed in the vertical direction so that the droplets are discharged in the horizontal direction.

According to the embodiment, the liquid discharging head composing the recording head 24 may include a piezoelectric actuator such as a piezoelectric element or the like, a thermal actuator where an electrothermal element such as a heat element or the like is used for boiling a film to be changed into a liquid by a phase change, a shape memory array actuator using a metal phase change caused by a temperature change, or an electrostatic actuator using an electrostatic force as pressure generating means for generating pressure for discharging droplets.

Although not shown in the drawings, the carriage 23 may further include a liquid discharging head that discharges a fixing solution which can raise the fixability of the ink by reacting with the ink.

Referring back to FIG. 1, the carriage 23 further includes head tanks 29 corresponding to the lines of nozzles Na and Nb of the recording heads 24*a* and 24*b* for supplying ink of corresponding colors to the lines of nozzles Na and Nb. The image forming apparatus 1 further includes ink cartridges (main tanks) 30 and supply tubes 31 of each color. The colors of ink are respectively provided through the supply tube 31 from the ink cartridges 30 to the head tanks 29 by the operation of a supply pump 13.

Referring to FIG. 2, the image forming unit 2 further includes a linear encoder (main scanning encoder) 123 for sensing the movement of the carriage 23. The linear encoder 123 is composed of encoder scales 121 having a predetermined pattern and an encoder sensor 122 attached to the carriage 23. The encoder sensor 122 may be a transmission photo sensor that reads the pattern of the encoder scales 121. The encoder scales 121 are provided between the side boards 101L and 101 R along the main scanning direction of the carriage 23.

Referring back to FIG. 1, the papers 10 stacked in the paper-feed tray 4 are separated one by one by a paper-feed roller (a meniscus roller) 43 and a separating pad 44 to be conveyed into the main body of the image forming apparatus 1. Then, the paper 10 is conveyed along a conveying guide member 45 to be inserted between a transfer belt 51 and a pressing roller 48 and is then held on the transfer belt 51.

The conveying mechanism 5 includes the annular transfer belt 51 hung between a transfer roller 52, which is a drive roller, and a driven roller 53, a charge roller 54 for charging the transfer belt 51, a platen member 55 for maintaining the flatness of the transfer belt 51 opposing the image forming unit 2, and the like.

The transfer belt 51 rotates in the belt transferring direction (sub scanning direction or a paper conveyed direction) as the transfer roller 52 is rotated by a sub scanning motor 131 via a timing belt 132 and a timing pulley 133. Hereinafter, a part of the transfer belt 51 facing the image forming unit 2 to hold the paper 10 between the transfer roller 52 and the driven roller 53 is referred to as a forward conveying part 51*a* and the other part of the transfer belt 51 between the transfer roller 52 and the driven roller 53 is referred to as a backward conveying part 51*b*.

Further, as shown on the right side of FIG. 2, the image forming apparatus 1 may further include a rotary encoder (sub scanning encoder) 136 including a code wheel 134 on which a predetermined pattern is formed and attached to the axle 52*a* of the transfer roller 52 and an encoder sensor 135 composed of a transmission photo sensor for detecting the pattern formed on the code wheel 134. The movement amount and the position of the transfer belt 51 can be detected by the code wheel 134 and the encoder sensor 135.

The paper ejecting unit 6 includes a paper ejecting guide member 61, a paper ejecting driving roller 62, a spur 63, a paper ejecting roller 64 and a spur 65. The paper 10 on which an image is formed is ejected between the paper ejecting roller 64 and the spur 65 on the paper-catch tray 7 with its face down.

The reverse unit 8 includes a changeover claw 81, a reverse guide member 82, a reverse roller 83, a spur 84, which is also a reverse roller, a driven assistance roller 85 facing the driven roller 53, and a bypass guide member 86. The changeover claw 81 changes the conveyance direction of the paper 10, a part of which is ejected on the paper-catch tray 7, from a paper ejecting path to a reverse path to have the paper 10 reversed by a switch-back mechanism inserted between the transfer belt 51 and the pressing roller 48. The bypass guide member 86 guides the paper 10 separated from the backward conveying part 51*b* of the transfer belt 51 to be introduced between the transfer belt 51 and the pressing roller 48 while bypassing the charge roller 54.

According to the image forming apparatus 1 thus structured, the papers 10 are separately fed from the paper-feed tray 4 one by one to be attached and held on the charged transfer belt 51 to be vertically conveyed with the rotation of the transfer belt 51. The transfer belt 51 is rotated intermittently. When the recording head 24 is driven in accordance with the image signal while moving the carriage 23 and the transfer belt 51 is not rotated, ink droplets are discharged on the still paper 10 to form a single line of an image. After the single line of the image is formed, a predetermined amount of the paper is conveyed and then a next single line of the image is formed on the paper. After repeating this operation and the recording of the image is completed, the paper 10 is ejected on to the paper-catch tray 7.

When duplex printing is performed, recording on the first side of the paper 10 is performed as described above, and when the back end of the paper 10 passes the changeover claw 81, the paper ejecting roller 64 is reversely rotated to have the paper 10 switch back to be introduced to the reverse guide member 82. Then, the paper 10 is conveyed between the reverse roller 83 and the spur 84 and then further conveyed between the backward conveying part 51*b* of the transfer belt 51 and the driven assistance roller 85.

Then, the paper 10 is held on the transfer belt 51 and conveyed with the transfer belt 51 when the transfer belt 51 is rotated. Consequently, the paper 10 is separated from the transfer belt 51 at the transfer roller 52 to be guided to the bypass route by the bypass guide member 86. Then, the paper 10 is inserted again between the forward conveying part 51*a* of the transfer belt 51 and the pressing roller 48 and held on the transfer belt 51 to be conveyed to the image forming region of the recording head 24 so that an image is formed on the reverse side of the paper 10. After that, the paper 10 is ejected on to the paper-catch tray 7.

Here, as the charge roller 54 is positioned inside the bypass route of the reverse mode (inside the bypass guide member 86), the paper 10 is held on the transfer belt 51 newly charged by the charge roller 54.

Referring to FIG. 2, the image forming unit 2 further includes a maintenance and recovery mechanism 9 provided at one side of the main scanning direction of the carriage 23 (left side in FIG. 2), which is a non-printing region, for maintaining and recovering the condition of the nozzles 124*b* of the recording head 24.

The maintenance and recovery mechanism 9 includes a cap member 90, a wiper member (wiper blade) 93, and a liquid receiver 94. The cap member 90 includes a suction cap member 92A and a moisture retention cap member 92B for capping the nozzle surface 124 (see FIG. 3) of the recording head 24.

The wiper member (wiper blade) 93 wipes the nozzle surface 124 of the recording head 24. The liquid receiver 94 receives liquids which are not used for recording to remove thickened ink from the recording head 24 by an extra discharging process.

The maintenance and recovery mechanism 9 may further include a suction pump 96 connected to the suction cap member 92A as a suction unit, a waste tank 97 connected to the suction pump 96, and a switch unit 98.

Next, operation of the maintenance and recovery of the nozzles 124*b* of the recording head 24 by the maintenance and recovery mechanism 9 will be explained. When this operation is performed, the carriage 23 is transferred to the position, which is called a home position, facing the maintenance and recovery mechanism 9 so that the nozzle surface 124 of the recording head 24 is capped by the suction cap member 92A or the moisture retention cap member 92B. Then, the maintenance and recovery operation including suctioning the liquids in the nozzles 124*b*, and an extra discharging of droplets not used for forming an image are performed. With this operation, ink can be stably discharged from the recording head 24 to form an image.

Figure 4:
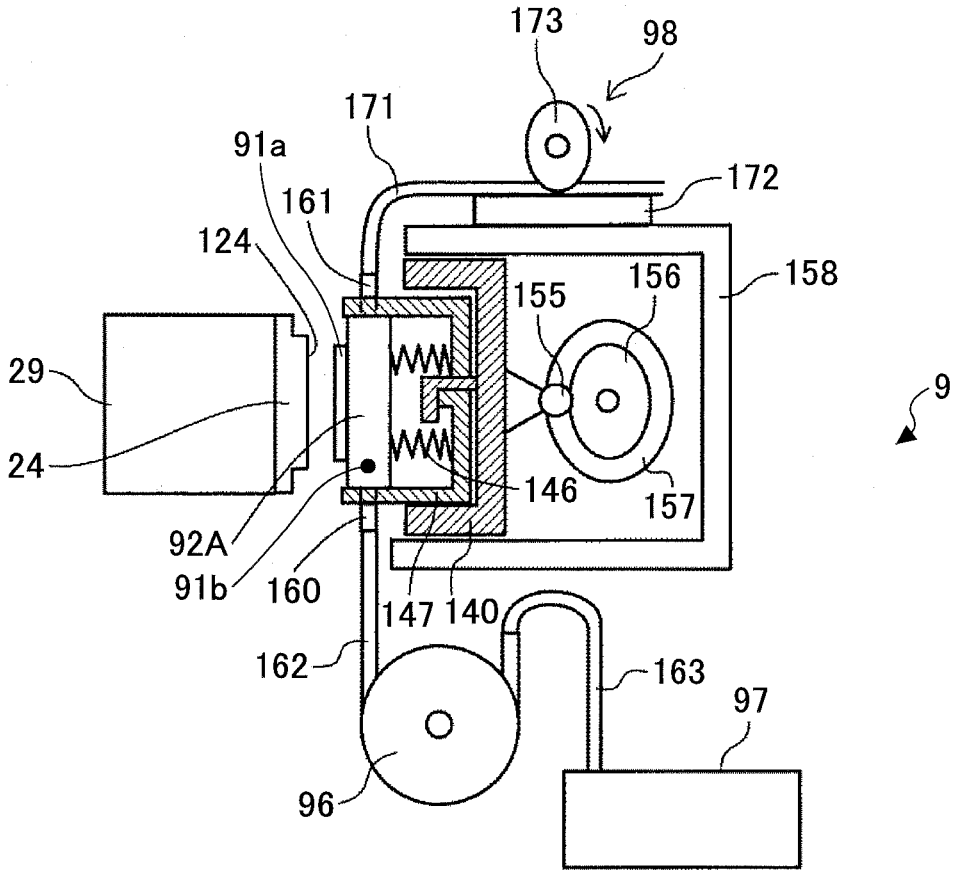
FIG. 4 is an explanatory view showing the structure of the maintenance and recovery mechanism according to the embodiment.

FIG. 4 is an explanatory view showing the structure of the maintenance and recovery mechanism 9 according to the present embodiment.

The recording head 24 and the head tanks 29 may be integrally formed in this embodiment. The nozzle surface 124 is positioned substantially vertical (including vertical) to the substantially horizontal direction.

The suction cap member 92A caps the nozzle surface 124 to retain moisture of the nozzles 124*b* and protect the nozzles 124*b*. The suction cap member 92A includes a contacting part 91*a* that contacts the nozzle surface 124 of the recording head 24 and a space 91*b*.

The maintenance and recovery mechanism 9 may further include a guide member 158, a cap slider 140 slidably incorporated in the guide member 158, a cap holder 147 that holds the suction cap member 92A and is held in the cap slider 140, a pressing spring 146 (pressing unit), and a cam 156.

The pressing spring 146 presses the suction cap member 92A toward the nozzle surface 124 of the recording head 24 so that the contact between the contacting part 91*a* of the suction cap member 92A and the nozzle surface 124 of the recording head 24 is tightened. The cap slider 140 includes a cam pin member 155 that movably engages a cam groove 157 of the cam 156 so that the cap slider 140 is moved forward toward the nozzle surface 124 to have the contacting part 91*a* be in contact with the nozzle surface 124 and backward from the nozzle surface 124 to have a space therebetween when the cam 156 rotates. The cap holder 147 is fixed by a stopper provided in the cap slider 140.

The suction cap member 92A includes a release port 161 formed at the upper side thereof and a suction port 160 formed at the lower side thereof. The maintenance and recovery mechanism 9 may further include a suction channel 162, and a waste channel 163.

The suction pump 96 may be a tube pump including a tube. One end of the suction channel 162 is connected to the suction port 160 and the other end of the suction channel 162 is connected to one side of the tube of the suction pump 96. One end of the waste channel 163 is connected to the other side of the tube of the suction pump 96 and the other end of the waste channel 163 is connected to the waste tank 97. With this structure, the air or the liquid suctioned from the suction cap member 92A flows to the waste tank 97 via the suction channel 162, the tube of the suction pump 96, and the waste channel 163. The suction channel 162 and the waste channel 163 may be composed of respective tubes.

The switch unit 98 opens and closes the release port 161 of the suction cap member 92A to the air, or to the atmosphere. In this embodiment, the switch unit 98 is capable of adjusting the opening amount of the release port 161 to at least a first opening amount and a second opening amount larger than the first opening amount.

The switch unit 98 may include a release channel 171, a base member 172, and a cam (pressing member) 173. The release channel 171 may be composed of an elastic transformable tube. One end portion of the release channel 171 is connected to the release port 161 of the suction cap member 92A and the other end portion of the release channel 171 is open to the atmosphere.

The cam 173 variably presses the release channel 171. Specifically, the cam 173 is rotatably provided to press the release channel 171 crossing on the base member 172. By rotating the cam 173, the amount of pressing the release channel 171 can be adjusted.

In this embodiment, the cam 173 may be rotated to take at least three positions including a first position where the release channel 171 is completely pressed by the cam 173 and the release port 161 is closed to the atmosphere, a second position where a small airway (first opening amount) is formed in the release channel 171 between the cam 173 and the base member 172, and a third position where a larger airway (second opening amount) larger than that of the second position is formed in the release channel 171 between the cam 173 and the base member 172. The third position may be a position where the release channel 171 between the cam 173 and the base member 172 is not pressed by the cam 173 at all. The base member 172 may be formed with a groove in which the release channel 171 is embedded so that the release channel 171 can be completely pressed by the cam 173 when the cam 173 takes the first position. The cam 173 may be commonly driven by a driver driving the cam 156, or may be independently driven by another driver different from that of the cam 156.

The image forming apparatus 1 may further include a control unit that controls the suction pump 96 and the switch unit 98 so that first the liquid in the nozzles 124*b* of the recording head 24 is suctioned by the suction pump 96 from the suction port 160, the release port 161 is then opened to the first opening amount to have a predetermined amount of air flow into the suction cap member 92A, and after the predetermined amount of air flows into the suction cap member 92A, the release port 161 is opened to the second opening amount.

Figure 5:
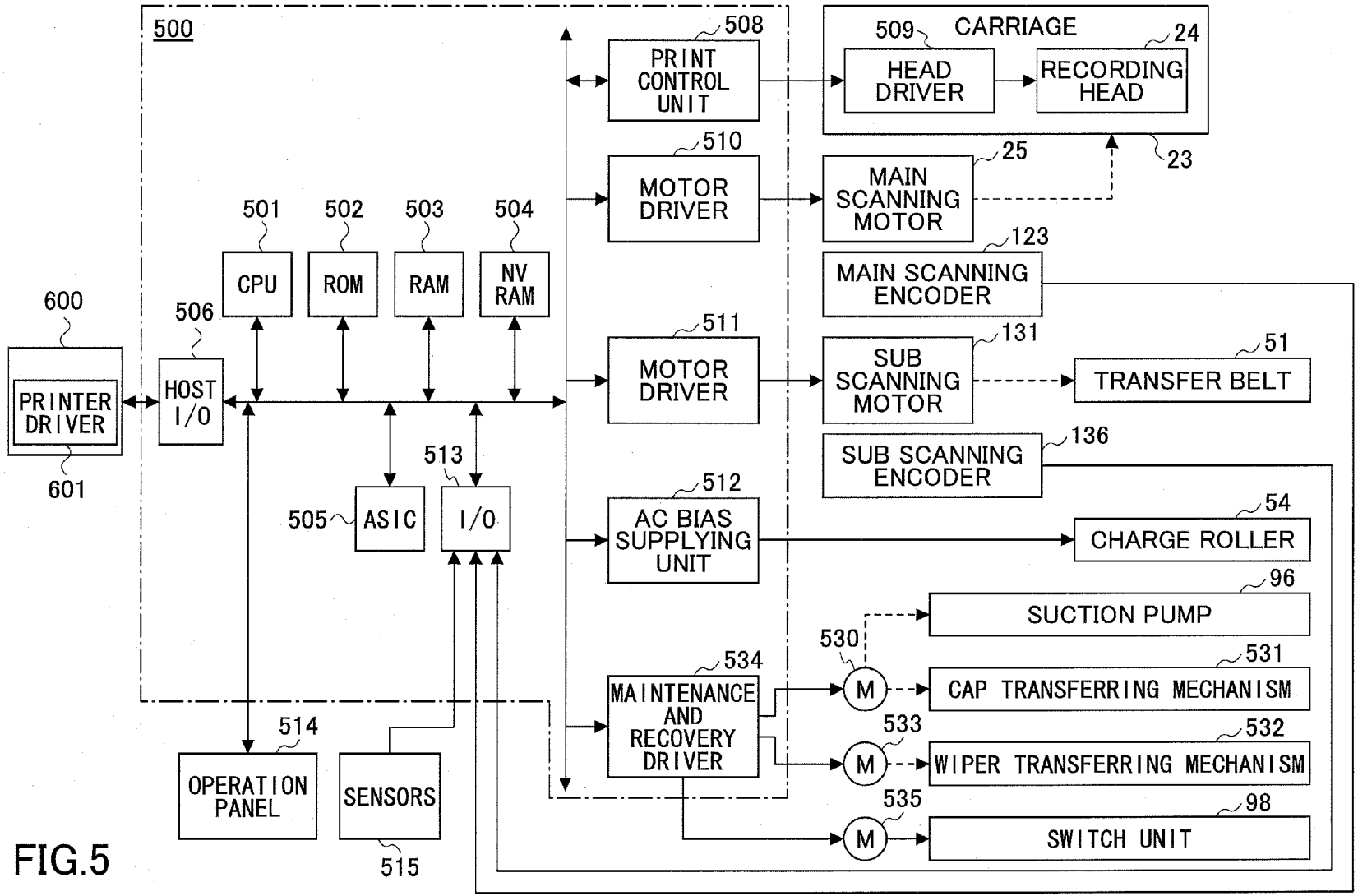
FIG. 5 is a block diagram showing the structure of the control unit according to the embodiment.

The function of a control unit 500 of the image forming apparatus will be explained with reference to the block diagram of FIG. 5.

The control unit 500 includes a CPU (Central Processing Unit) 501, a ROM (Read Only Memory) 502, a RAM (Random Access Memory) 503, a rewritable NVRAM (non-volatile RAM, simply shown as NVRAM in FIG. 5) 504, an ASIC (Application Specific Integrated Circuit) 505, a host interface 506 (simply shown as host I/F in FIG. 5), a print control unit 508, motor drivers 510 and 511, an AC bias supplying unit 512, an interface 513 (simply shown as I/F in FIG. 5), a maintenance and recovery driver 534, and the like.

The CPU 501 controls all operations of the image forming apparatus 1. The ROM 502 stores plural kinds of programs including programs to have the CPU 501 execute operations of the image forming apparatus 1 of the embodiments, and other fixed data. The RAM 503 temporarily stores image data or the like. The NVRAM 504 is capable of storing data even when the power of the image forming apparatus 1 is turned off. The ASIC 505 includes plural kinds of signal processing for image data, image processing such as sequencing image data, and other processing for input/output signals for controlling all of the image forming apparatus 1.

The print control unit 508 includes a data transfer unit that controls and drives the recording head 24, and a driving signal generation unit that generates signals for driving the recording head 24. The carriage 23 may further include a head driver 509 (driver IC) that drives the recording head 24 and is provided near the carriage 23. The motor drivers 510 and 511 respectively drive the main scanning motor 25 that moves the carriage 23 and the sub scanning motor 131 that rotates the transfer belt 51. The AC bias supplying unit 512 supplies AC bias voltage to the charge roller 54.

Further, the image forming apparatus 1 may include an operation panel 514 by which information necessary for the image forming apparatus 1 is input and displayed, connected to the control unit 500.

The host I/F 506 sends/receives signals from/to a host 600. The host 600 may be a data processing device such as a personal computer, an image scanning device such as an image scanner, an imaging device such as a digital camera, or the like. The host I/F 506 may receive data from the host 600 via a cable or a network.

The CPU 501 of the control unit 500 reads and analyzes the print data stored in a receiver buffer contained in the host I/F 506, controls the ASIC 505 to perform required image processing or data sorting and then transfers the print data to the head driver 509 through the print control unit 508. Dot pattern data for printing images is generated at a printer driver 601 of the host 600.

The print control unit 508 serially transfers the image data. The print control unit 508 further outputs transfer clocks, latch signals, or control signals necessary for transferring the image data and determining the transferring to the head driver 509. The print control unit 508 may further include a drive signal generator composed of a D/A converter for converting pattern data of a drive pulse stored in the ROM 502 and a voltage amplifier, a current amplifier, or the like to output drive signal composed of a single drive pulse or plural of the drive pulses to the head driver 509.

The head driver 509 drives the recording head 24 by selectively applying a drive pulse composing drive signals transferred from the print control unit 508 based on image data corresponding to a line serially input to a drive element (piezoelectric element, for example) for generating energy to have droplets of the recording head 24 be discharged. At this time, by selecting the drive pulse composing the drive signal, the droplets can be adjusted to various sizes including a large drop, a middle drop, a small drop or the like to form dots of various sizes.

The I/O UNIT 513 receives information from various sensors 515 attached to the main scanning encoder 123, the sub scanning encoder 136, or other parts of the apparatus 1 and extracts information necessary for controlling print operations to control the print control unit 508, the motor drivers 510 and 511, and the AC bias supplying unit 512.

The sensors 515 may include an optical sensor (or a paper sensor) attached to the carriage 23 for detecting the position of the paper 10, thermistors for monitoring the temperature or humidity in the apparatus 1, a sensor for monitoring the voltage of the charged transfer belt 51, an interlock switch for detecting the open/close condition of a cover, and the like. The I/O unit 513 may process various sensor information.

The CPU 501 calculates a drive value (or a control value) for the main scanning motor 25 based on a detected speed and a detected position obtained by sampling the detected pulses output from the encoder sensor 122 composing the main scanning encoder 123, and a previously stored speed/position profile data, for example. Then, the CPU 501 controls the main scanning motor 25 via the motor driver 510.

Similarly, the CPU 501 calculates a drive value (or a control value) for the sub scanning motor 131 based on a detected speed and a detected position obtained by sampling the detected pulses output from the encoder sensor 135 composing the sub scanning encoder 136, and a previously stored speed/position profile data, for example. Then, the CPU 501 controls the sub scanning motor 131 via the motor driver 511.

The image forming apparatus 1 may further include a cap transferring mechanism (including the previously mentioned cam 156) 531, a wiper transferring mechanism 532, a motor 530 for driving the suction pump 96 and the cap transferring mechanism 531, a motor 533 for driving the wiper transferring mechanism 532, and a motor 535 for driving the switch unit 98.

The maintenance and recovery driver 534 controls the motor 530 to have the cap transferring mechanism 531 move the cap member 92 forward and backward toward the nozzle surface 124 of the recording head 24 and to actuate the suction pump 96. In this embodiment, when the motor 530 is rotated in a first direction, the cap transferring mechanism 531 moves the cap member 90 with respect to the nozzle surface 124 of the recording head 24; while the motor 530 is rotated in a second direction opposite to the first direction, the suction pump 96 is activated to suction the suction cap member 92A.

The maintenance and recovery driver 534 controls the motor 533 to have the wiper transferring mechanism 532 move the wiper member 93. The maintenance and recovery driver 534 controls the motor 535 to rotate the cam 173 of the switch unit 98.

Next, the maintenance and recovery mechanism of the first embodiment will be explained referring to FIGS. 1 to 6.

Figure 6:
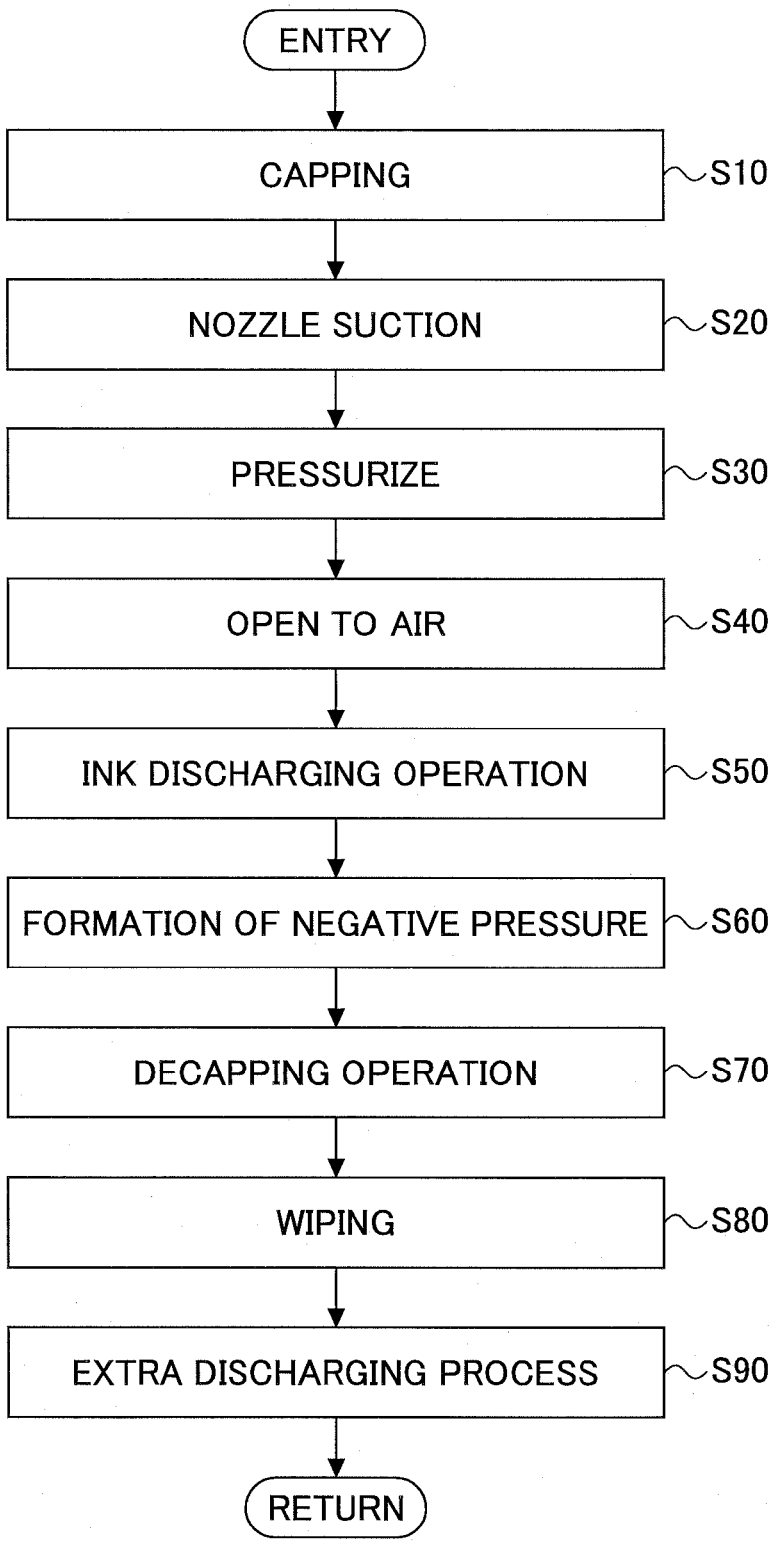
FIG. 6 is a flowchart showing the maintenance and recovery operation of the image forming apparatus according to the embodiment.

FIG. 6 is a flowchart showing the maintenance and recovery operation according to the image forming apparatus 1 of this embodiment.

The maintenance and recovery operation may be performed when the nozzles 124*b* of the recording head 24 are blocked, when a meniscus formed on the nozzle surface 124 is broken as the head tank 29 is not kept at a negative pressure, at a predetermined timing or the like.

During the maintenance and recovery operation, the recording head 24 is transferred to the home position facing the suction cap member 92A. Then, the suction cap member 92A is also moved by driving the cap transferring mechanism 531 so that the nozzle surface 124 of the recording head 24 is capped by the suction cap member 92A (S10: capping). At this time, the switch unit 98 is closed.

Then the suction pump 96 is actuated to have the space 91*b* of the suction cap member 92A kept at a negative pressure so that ink in the nozzles 124*b* of the recording head 24 is suctioned to the suction cap member 92A (S20: nozzle suction).

After the suction cap member 92A is suctioned by the suction pump 96 for a while so that the pressure in the suction cap member 92A becomes a predetermined value, the operation of the suction pump 96 is terminated.

When the tube pump as described above is used as the suction pump 96, the tube of the suction pump 96 is pressed by rollers as will be explained later with reference to FIGS. 17A and 17B. Therefore, when the operation of the suction pump 96 is terminated, the tube of the suction pump 96 is pressed by the rollers. It means that the suction port 160 is closed by the suction pump 96 when the suction pump 96 is not being operated.

After that, the supply pump 13 is driven forward to provide ink from the cartridge 30 to the head tank 29 to pressurize the head tank 29 and the recording head 24 so that the negative pressure level is lowered or altered to a positive pressure in the head tank 29 and the recording head 24 (S30: pressurize).

After that, the switch unit 98 is controlled to open the release port 161 to the atmosphere (S40: open to the atmosphere). At this time, the suction port 160 of the suction cap member 92A is not opened to the atmosphere. Concretely, as mentioned above, the tube of the suction pump 96 is pressed by the rollers and the suction port 160 is closed by the suction pump 96 so that the air in the suction cap member 92A cannot be released from the suction port 160 at this time.

Figure 20:
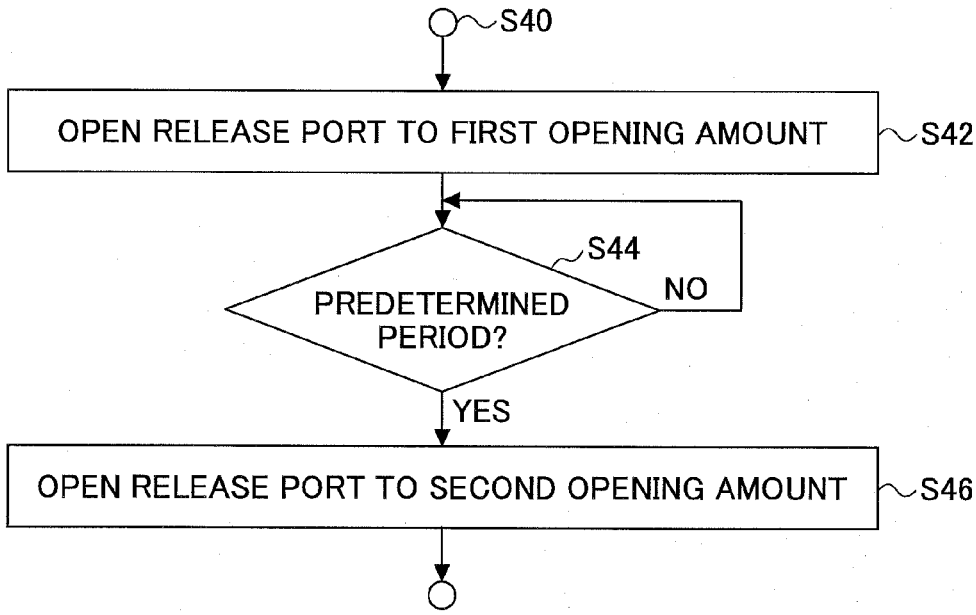
FIG. 20 is a flowchart showing an example of an operation of opening the release port to the air in detail.

FIG. 20 is a flowchart showing an example of an operation of opening the release port 161 to the atmosphere in detail. According to the image forming apparatus 1 of the present embodiment, the maintenance and recovery driver 534 of the control unit 500 controls the motor 535 to rotate the cam 173 of the switch unit 98 for a first amount so that a small airway of a first opening amount is formed in the release channel 171 (S42). With this operation air is gradually introduced into the space 91*b* of the suction cap member 92A. After a predetermined period has passed (YES of S44), the maintenance and recovery driver 534 of the control unit 500 controls the motor 535 to further rotate the cam 173 of the switch unit 98 for a second amount so that a fully opened airway of a second opening amount is formed in the release channel 171 (S46). Here, the control unit 500 functions as the control unit that opens and closes the release port of the cap member to the atmosphere or the air. At this time, the release channel 171 between the cam 173 and the base member 172 is not pressed by the cam 173 at all. The predetermined period may be two to three seconds or the like, for example.

Referring back to FIG. 6, alternately, in step S40, the maintenance and recovery driver 534 of the control unit 500 may control the motor 535 to gradually rotate the cam 173 of the switch unit 98 so that air is gradually introduced into the space 91*b* of the suction cap member 92A.

Thereafter, by driving the suction pump 96 again, the ink suctioned from the nozzles 124*b* of the recording head 24 and remaining in the suction cap member 92A is discharged to the waste tank 97 via the suction channel 162 and the waste channel 163 (S50: ink discharging operation).

After this operation, the supply pump 13 is driven reverse to have the ink in the head tank 29 move back to the ink cartridge 30 so that a desired negative pressure is formed in the head tank 29 and the recording head 24 (S60: formation of negative pressure).

Then, the cap transferring mechanism 531 is driven to have the suction cap member 92A move away from the nozzle surface 124 of the recording head 24 (S70: decapping operation) Thereafter, the nozzle surface 124 of the recording head 24 is wiped and cleaned by the wiper member 93 (S80: wiping).

Thereafter, the droplets not contributing to forming an image are discharged to the liquid receiver 94 (S90: extra discharging process).

Figure 7:
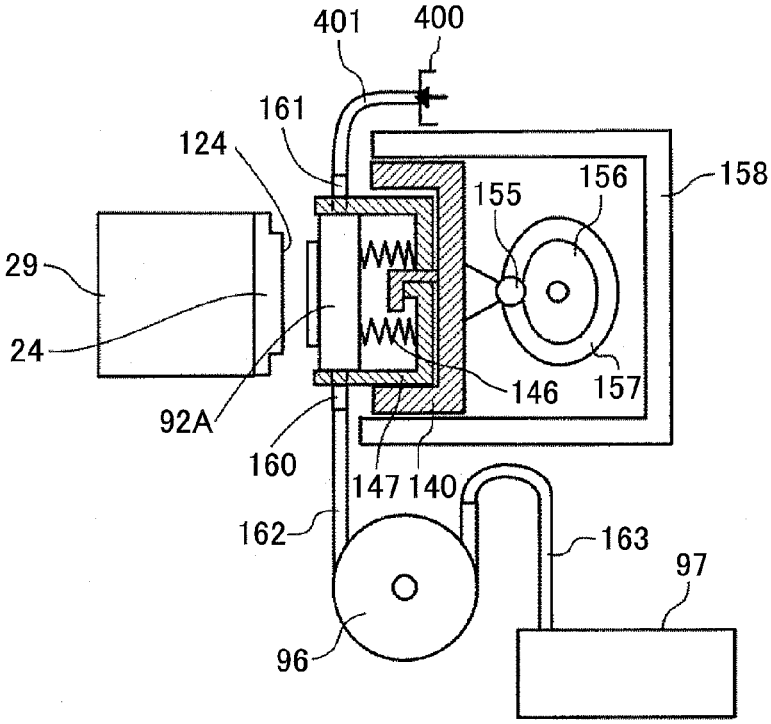
FIG. 7 is an explanatory view showing a structure of a maintenance and recovery mechanism that does not include the switch unit of the embodiment.

FIG. 7 is an explanatory view showing a structure of a maintenance and recovery mechanism that does not include the switch unit 98 of the present embodiment. Instead of the switch unit 98, the maintenance and recovery mechanism shown in FIG. 7 includes a switch valve 400 that simply completely opens and completely closes the release port 161 of the suction cap 90A to the atmosphere.

In this example as well, the nozzle surface 124 is capped by the suction cap member 92A, and inside the suction cap member 92A is suctioned by the suction pump 96 to become a negative pressure so that ink in the nozzles 124*b* is discharged to the suction cap member 92A. When the operation of the suction pump 96 is terminated, ink in the suction cap member 92A flows down to the suction channel 162 by the force of gravity. As mentioned above, when the suction cap member 92A is decapped from the nozzle surface 124 at this stage, the ink leaks from the suction cap member 92A. Therefore, in this case as well, the suction cap member 92A is decapped after the suction cap member 92A is opened to the atmosphere, and the ink (waste liquid) remaining in the suction cap member 92A is suctioned by the suction pump 96.

However, when the release port 161 of the suction cap member 92A is drastically opened after inside the suction cap member 92A is suctioned by the suction pump 96 to become a negative pressure so that the ink in the nozzles 124*b* is discharged, the waste liquid in the suction cap member 92A floods the release channel 401 to blow out from the switch valve 400.

Figure 8:
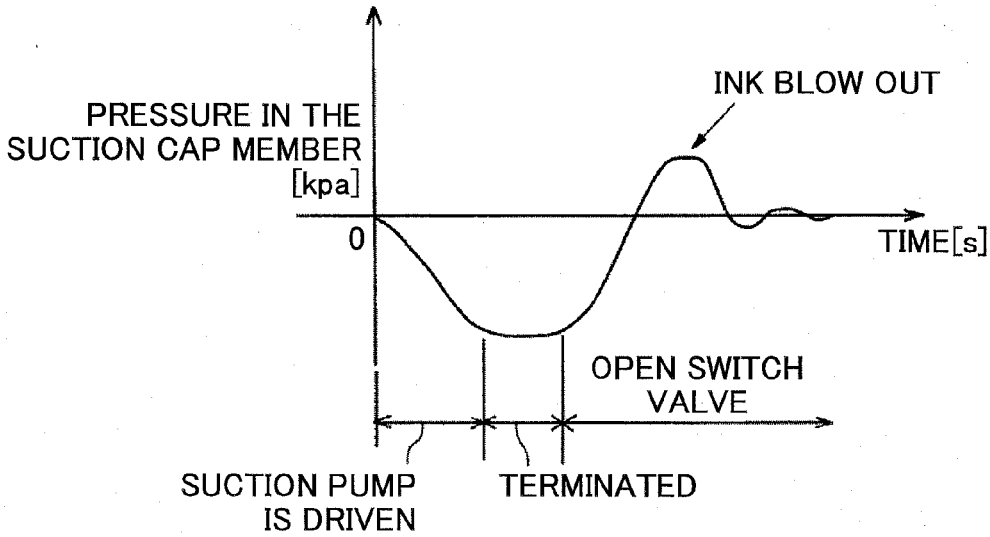
FIG. 8 is a diagram showing the phenomenon using the maintenance and recovery mechanism shown in FIG. 7.

FIG. 8 is a diagram showing this phenomenon. When the suction pump 96 is driven, the pressure in the suction cap member 92A is lowered to become a negative pressure. It means that by driving the suction pump 96, the pressure difference between the negative pressure in the suction cap member 92A and the atmospheric pressure becomes large. When the operation of the suction pump 96 is terminated, the negative pressure in the suction cap member 92A is maintained. When the release port 161 is fully opened and air drastically moves into the suction cap member 92A, when there is no release way for the air, the air is temporarily compressed because of the compressibility of the air, to have the pressure in the suction cap member 92A become positive to cause an overshoot.

By this overshoot, as the waste liquid remaining in the suction cap member 92A has no way to be released other than the release port 161, the waste liquid floods the release channel 401 to blow out from the switch valve 400.

On the other hand, according to the image forming apparatus 1 of the present embodiment, the image forming apparatus 1 includes the switch unit 98 as shown in FIG. 4, in which the release channel 171 connected to the release port 161 of the suction cap member 92A is composed of the elastic transformable tube, and the cam 173 to press the release channel 171 is provided. As the release channel 171 is composed of the elastic material, even after the cam 173 presses the release channel 171, the shape of the release channel 171 is recovered when the cam 173 is rotated not to press the release channel 171 anymore. It means that the opening amount of the release port 161 is controlled by the rotation amount of the cam 173 and capable of adjusting the opening amount between the suction cap member 92A and the atmosphere to a desired amount.

According to the present embodiment, when the suction cap member 92A is suctioned by the suction pump 96, as it is necessary to completely close the release port 161, the cam 173 is rotated to completely press the release channel 171. After the operation of the suction pump 96 is terminated, the cam 173 is slightly rotated to open the release port 161 a small amount (first opening amount). When the opening amount of the release port 161 is small, the amount of air that flows into the suction cap member 92A can be reduced so that the compression amount in the suction cap member 92A can be reduced as well. Therefore, the overshoot as mentioned above with reference to FIGS. 7 and 8 does not occur. Consequently, the blowing out of the waste liquid from the release port 161 can be prevented.

The image forming apparatus 1 of the present embodiment has the following structure. The switch unit opens and closes the release port of the cap member to the air. The switch unit is capable of adjusting the opening amount of the release port to at least a first opening amount and a second opening amount larger than the first opening amount. The control unit controls the suction unit and the switch unit so that the liquid in the nozzles of the recording head is suctioned by the suction unit from the suction port, the release port is then opened to the first opening amount to have a predetermined amount of the air flow into the cap member, and the release port is opened to the second opening amount after the predetermined amount of the air flows into the cap member.

As mentioned above, according to the image forming apparatus 1 of the present embodiment, the blowing out of the waste liquid in the suction cap member 92A from the release port 161 can be prevented because the pressure in the suction cap member 92A gradually recovers even when the release port is opened to the atmosphere after the pressure in the suction cap member 92A is lowered to a negative pressure.

It means that the switch unit 98 and the control unit 500 that controls the operation of the suction pump 96 and the switch unit 98 according to the present embodiment serve as a pressure recovery delay mechanism that delays the recovery of the pressure in the suction cap member 92A after the pressure in the suction cap member 92A is lowered by being suctioned by the suction pump 96 and then released to the atmosphere by operating the switch unit 98 to open the release port 161 of the suction cap member 92A to the atmosphere.

Figure 21:
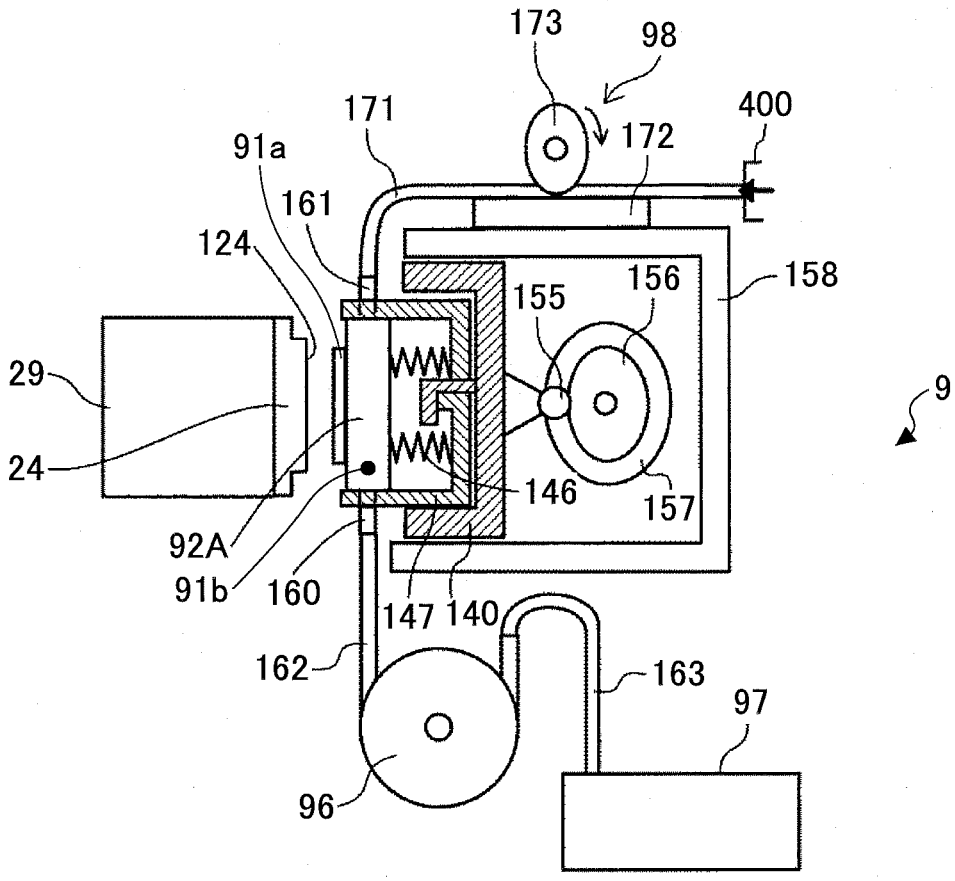
FIG. 21 is an explanatory view showing the structure of the maintenance and recovery mechanism according to another embodiment.

The maintenance and recovery mechanism 9 as explained with reference to FIG. 4 may further include a switch valve 400 as shown in FIG. 21.

With this structure, when the suction pump 96 is driven to suction the suction cap member 92A, the switch valve 400 is closed and the cam 173 is rotated to completely press the release channel 171. After the operation of the suction pump 96 is terminated, switch valve 400 is opened and the cam 173 is slightly rotated to open the release port 161 a small amount. After a predetermined period, the cam 173 is rotated to fully open the release port 161. With this structure, the release port 161 is tightly closed when the suction cap member 92A is suctioned by the suction pump 96.

Second Embodiment

Next, the structure of the image forming apparatus 1 according to the second embodiment will be explained referring to FIGS. 9, 10A, 10B and 10C.

Figure 9:
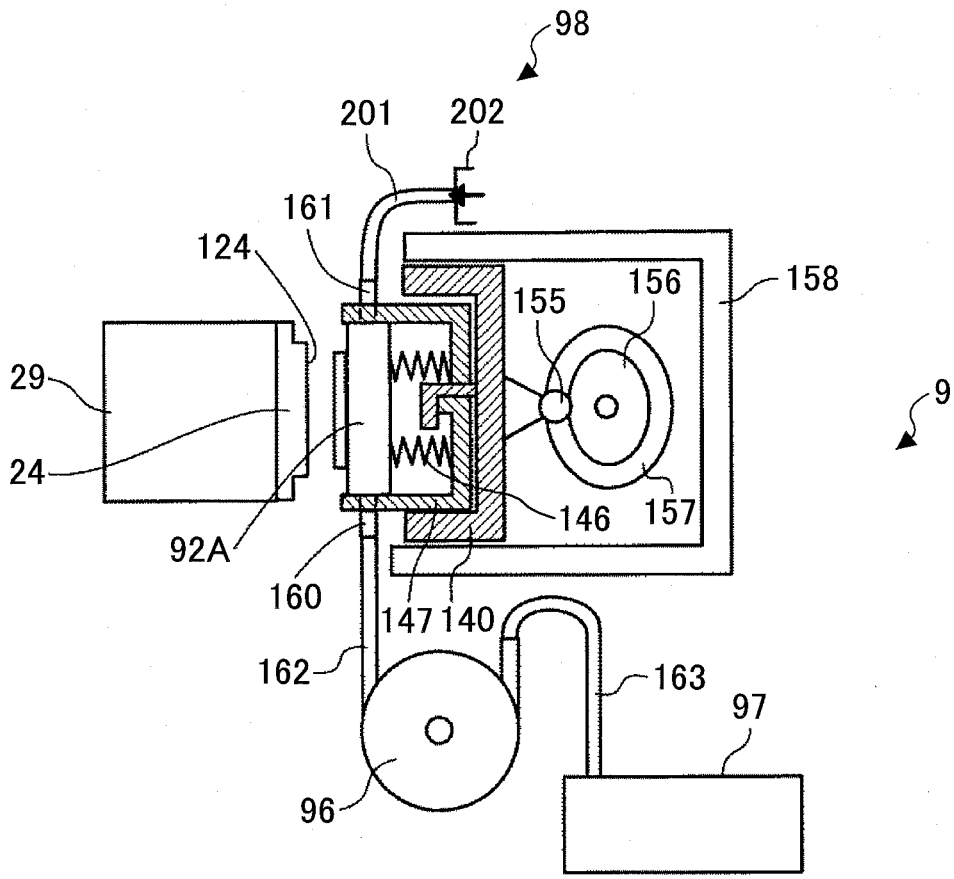
FIG. 9 is an explanatory view showing the structure of the maintenance and recovery mechanism according to another embodiment.
Figure 10A:
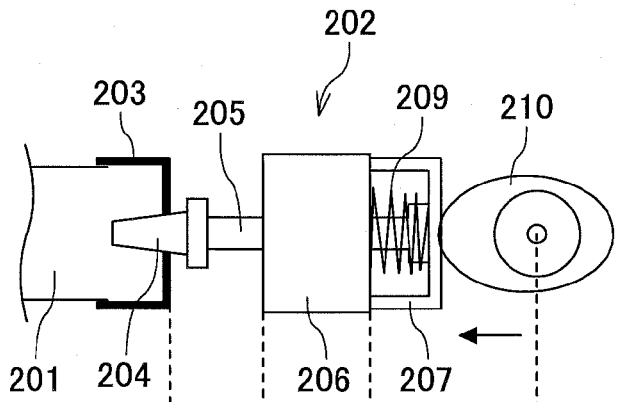
FIGS. 10A, 10B and 10C are drawings for explaining the operation of the maintenance and recovery mechanism shown in FIG. 9.
Figure 10B:
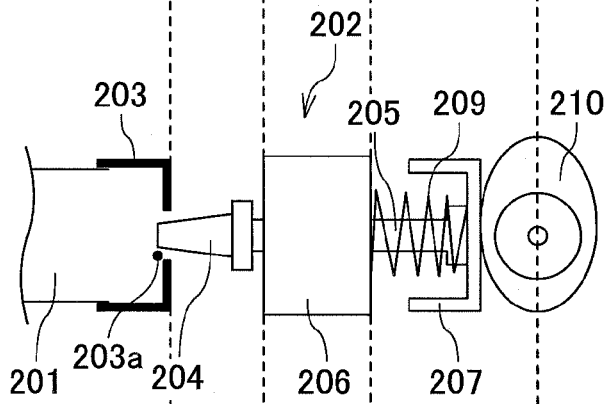
Figure 10C:
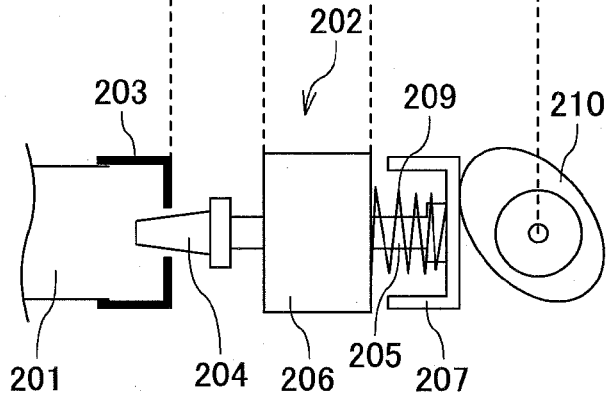

FIG. 9 is an explanatory view showing the structure of the maintenance and recovery mechanism 9 according to the present embodiment. FIGS. 10A, 10B and 10C are drawings for explaining the operation of the maintenance and recovery mechanism 9 of the present embodiment.

In this embodiment, the switch unit 98 includes a release channel 201, one end portion of which is connected to the release port 161 of the suction cap member 92A, and a switch valve 202 connected to the other end portion of the release channel 201 and capable of adjusting the opening amount of the release port 161 to the atmosphere.

As shown in FIGS. 10A, 10B and 10C, the switch valve 202 includes a valve seat 203 provided at the other end portion of the release channel 201 and having an opening 203*a*, a needle valve 204, an axle member 205, a pressure receiving member 207, and a cam 210.

The needle valve 204 has a needle shape and is provided to be slidably inserted in the opening 203*a* of the valve seat 203. The axle member 205 is integrally provided with the needle valve 204 and slidably inserted in the guide member 206. The pressure receiving member 207 is integrally provided with the axle member 205 at its end. The pressure receiving member 207 includes a pressing spring 209 (pressing unit) provided between the guide member 206 and the pressure receiving member 207. The pressing spring 209 presses the pressure receiving member 207 away from the guide member 206 so that the needle valve 204 is not inserted in the opening 203*a* of the valve seat 203 when the pressure receiving member 207 is not pressed by the cam 210. The cam 210 driven by a driver (not shown in the drawings) is rotatably provided to be in contact with the pressure receiving member 209. The guide member 206 may be a generally used linear bushing where plural spherules are provided in the hole provided inside thereof for reducing the friction resistance or the like.

The cam 210 may be commonly driven by the driver driving the cam 156, or may be independently driven by another driver different from that of the cam 156. The needle valve 204 may be composed of an elastic material so that the sealing between the needle valve 204 and the valve seat 203 is strengthened. The elastic material may be a material having low gas permeability and low moisture permeability.

As thus structured, as shown in FIG. 10A, when the cam 210 is rotated so that its part having a larger diameter contacts the pressure receiving member 207, the pressure receiving member 207 is pressed toward the guide member 206 against the resilient force of the pressing spring 209 and the needle valve 204 is inserted in the opening 203*a* of the valve seat 203 to close the opening 203*a*. At this time, the release port 161 (release channel 201) of the suction cap member 92A is closed.

When, on the other hand, as shown in FIG. 10B, the cam 210 is rotated so that its part having a smaller diameter contacts the pressure receiving member 207, the pressure receiving member 207 is moved away from the guide member 206 by the resilient force of the pressing spring 209 and the needle valve 204 is removed from the opening 203*a* of the valve seat 203 to open the opening 203*a*. At this time, the release port 161 (release channel 201) of the suction cap member 92A is opened to the atmosphere.

As the needle valve 204 has a shape of a needle whose the diameter becomes smaller along the front-end direction, the opening amount of the opening 203*a* depends on the position of the needle valve 204 with respect to the valve seat 203. It means that the opening amount of the opening 203*a* depends on the rotational angle of the cam 210. Therefore, by adjusting the rotational angle of the cam 210, the opening amount of the switch valve 202, in other words, the opening amount of the release port 161 (release channel 201) of the suction cap member 92A can be adjusted.

Therefore, when the cam 210 is rotated at the position between those shown in FIGS. 10A and 10B, as shown in FIG. 10C, the opening amount of the switch valve 202 can becomes smaller than that shown in FIG. 10B.

Therefore, according to the present embodiment, when the suction cap member 92A is suctioned by the suction pump 96 for discharging the liquid from the nozzles 124*b*, the cam 210 takes the position as shown in FIG. 10A. Then, after terminating the operation of the suction pump 96, the cam 210 is rotated to the position as shown in FIG. 10C so that the release port 161 of the suction cap member 92A is opened at a small opening amount. With this operation, the amount of air flowing into the suction cap member 92A can be reduced and the flowing out of the ink from the release port 161 can be prevented.

The maintenance and recovery operation is performed similarly to that explained in the first embodiment with reference to FIGS. 6 and 20 as well. Further, the switch valve 202 may be directly provided at the release port 161 of the suction cap member 92A in another example.

It means that the switch unit 98 and the control unit 500 that controls the operation of the suction pump 96 and the switch unit 98 according to the present embodiment serve as a pressure recovery delay mechanism that delays the recovery of the pressure in the suction cap member 92A after the pressure in the suction cap member 92A is lowered by being suctioned by the suction pump 96 and then released to the atmosphere by operating the switch unit 98 to open the release port 161 of the suction cap member 92A to the atmosphere.

Third Embodiment

Next, the structure of the image forming apparatus 1 according to the third embodiment will be explained referring to FIGS. 11, 12A and 12B.

Figure 11:
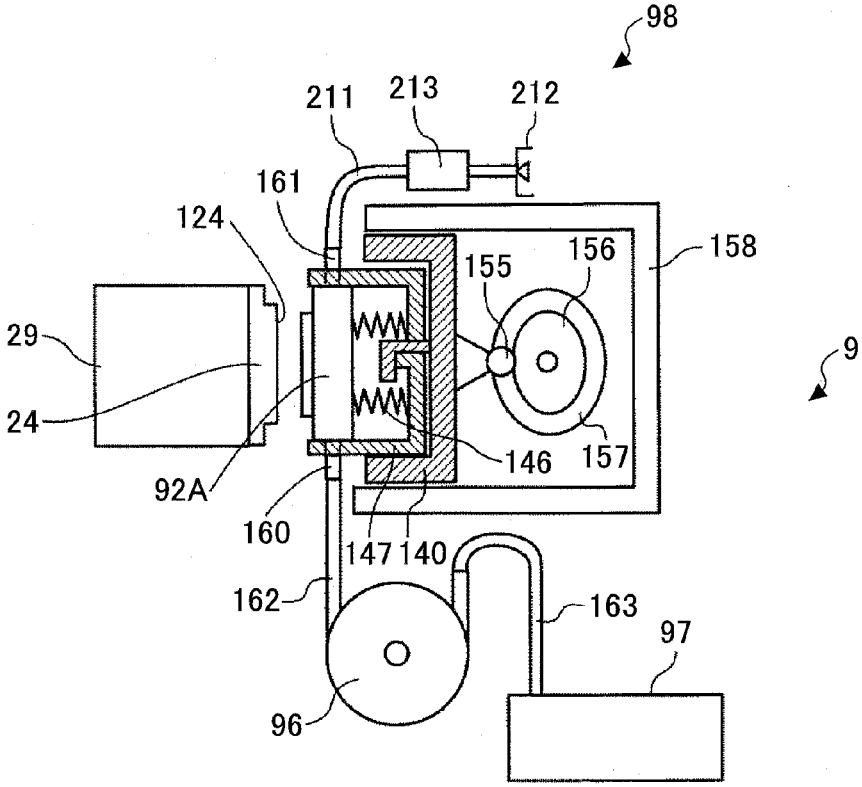
FIG. 11 is an explanatory view showing the structure of the maintenance and recovery mechanism according to another embodiment.
Figure 12A:
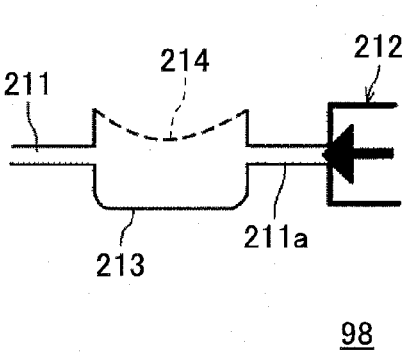
FIGS. 12A and 12B are drawings for explaining the operation of the maintenance and recovery mechanism shown in FIG. 11.

FIG. 11 is an explanatory view showing the structure of the maintenance and recovery mechanism 9 according to the present embodiment. FIGS. 12A and 12B are drawings for explaining the operation of the maintenance and recovery mechanism 9 of the present embodiment.

In this embodiment, the switch unit 98 includes a release channel 211, one end portion of which is connected to the release port 161 of the suction cap member 92A, a switch valve 212 provided at the other end portion of the release channel 201 and including a valve seat and a valve body, and a pressure buffer room 213 provided in the middle of the release channel 211. The pressure buffer room 213 includes a flexible film 124 composed of a flexible material and composing one face as shown in FIGS. 12A and 12B. Hereinafter, a part of the release channel 211 between the pressure buffer room 213 and the switch valve 212 is referred to as a pressure buffer channel 211*a*.

A flexible material composing the flexible film 214 may be a material having a thickness that easily flexes in accordance with a slight pressure change.

The flexible material may be a material having low gas permeability and low moisture permeability. The pressure buffer room 213 may be structured to have an appropriate volume to prevent the overshoot in the suction cap member 92A. The volume of the pressure buffer room 213 may be determined based on the pressure in the suction cap member 92A when it is suctioned by the suction pump 97. The flexible film 214 may form on other part in addition to the one face of the pressure buffer room 213.

When the suction pump 96 is driven to suction the suction cap member 92A to discharge the liquid in the nozzles 124*b* of the nozzle surface 124 while the switch valve 212 is closed, inside the suction cap member 92A, the release channel 211, the pressure buffer room 213, and the pressure buffer channel 211*a* communicating with the suction cap member 92A are suctioned to achieve negative pressure. Consequently, the flexible film 214 forms a concavity inside the pressure buffer room 213 as shown in FIG. 11A.

Figure 12B:
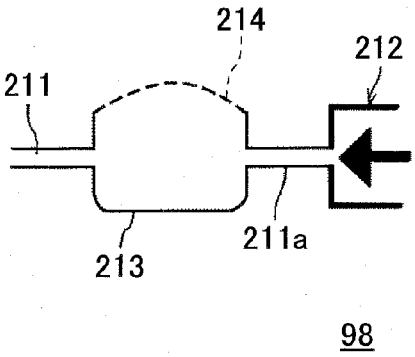

When the operation of the suction pump 96 is terminated and the switch valve 212 is opened as shown in FIG. 12B, air flows into the suction cap member 92A through the pressure buffer channel 211*a*, the pressure buffer room 213, the release channel 211 and the release port 161. When there is no release way for the air and the pressure in the suction cap member 92A becomes higher, the flexible film 214 of the pressure buffer room 213 protrudes outward to expand the pressure buffer room 213. It means that the volume of the closed area including the suction cap member 92A, the release channel 211, the pressure buffer room 213, and the pressure buffer channel 211*a* increases to delay or absorb the pressure recovery. Therefore, flowing out of the ink from the switch valve 212 because of the increase of the pressure in the suction cap member 92A can be prevented.

The image forming apparatus 1 of the present embodiment has the following structure. The buffer room is provided in the channel connected to the release port of the cap member at its one end where the switch unit is provided at the other end of the channel. At least a part of the buffer room is provided with a transformable flexible film composed of a flexible material.

As described above, with this structure, the recovery of the pressure in the suction cap member 92A can be delayed and the flowing out of the ink from the release port 161 can be prevented.

It means that the pressure buffer room 213 having the flexible film 124 according to the present embodiment serves as a pressure recovery delay mechanism that delays the recovery of the pressure in the suction cap member 92A after the pressure in the suction cap member 92A is lowered by being suctioned by the suction pump 96 and then released to the atmosphere by operating the switch unit 98 to open the release port 161 of the suction cap member 92A to the atmosphere.

Fourth Embodiment

Figure 13A:
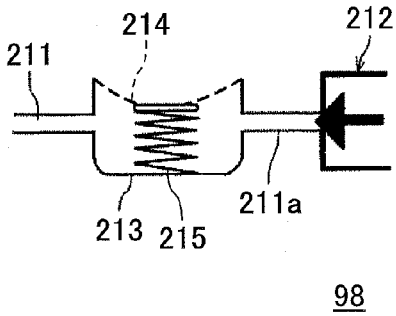
FIGS. 13A and 13B are drawings for explaining the operation of the maintenance and recovery mechanism of another embodiment.
Figure 13B:
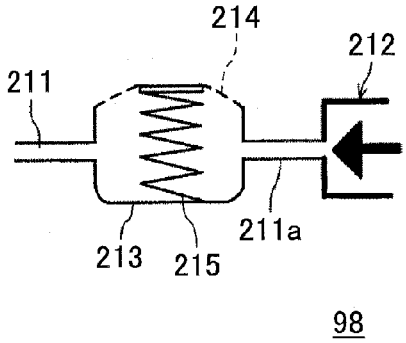

Next, the structure of the image forming apparatus 1 according to the fourth embodiment will be explained referring to FIGS. 13A and 13B. FIGS. 13A and 13B are drawings for explaining the operation of the maintenance and recovery mechanism 9 of the present embodiment. In this embodiment, the switch unit 98 may further include a pressing spring 215 (pressing unit) provided inside the pressure buffer room 213 and pressing the flexible film 214 outward in addition to the elements described in the third embodiment.

With this structure of the present embodiment, when the pressure buffer room 213 is suctioned by the suction pump 96 together with the suction cap member 92A, the flexible film 214 forms a concavity inside the pressure buffer room 213 against the resilient force of the pressing spring 215. When, on the other hand, the pressure buffer room 213 and the suction cap member 92A are released to the atmosphere, the pressing spring 215 presses the flexible film 214 outward to easily expand the pressure buffer room 213.

When the suction pump 96 is driven to suction the suction cap member 92A to discharge the liquid in the nozzles 124*b* of the nozzle surface 124 while the switch valve 212 is closed, inside the suction cap member 92A, the release channel 211, the pressure buffer room 213, and the pressure buffer channel 211*a* communicating with the suction cap member 92A are suctioned to achieve negative pressure. At this time, the flexible film 214 forms a concavity inside the pressure buffer room 213 against the resilient force of the pressing spring 215 as shown in FIG. 13A.

When the operation of the suction pump 96 is terminated and switch valve 212 is opened as shown in FIG. 13B, air flows into the suction cap member 92A through the pressure buffer channel 211*a*, the pressure buffer room 213, the release channel 211 and the release port 161. When there is no release way for the air and the pressure in the suction cap member 92A becomes higher, the flexible film 214 of the pressure buffer room 213 protrudes outward to expand the pressure buffer room 213. At this time, the flexible film 214 easily expands outward because of the resilient force of the pressing spring 215. Further, because of the resilient force of the pressing spring 215, the flexible film 214 quickly expands outward in response with the open operation of the switch valve 212. It means that the period required for expanding the flexible film 214 upon the opening operation of the switch valve 212 can be shortened.

With this structure, in this embodiment, the flexible film 214 can expand with high responsiveness compared with that of the third embodiment in accordance with the opening operation of the switch valve 212 to buffer the pressure increase in the suction cap member 92A. Therefore, flowing out of the ink from the switch valve 212 can be prevented with high reliability.

The pressing spring 215 may have a resilient force by which the flexible film 214 can form a concavity inside the pressure buffer room 213 when the suction cap member 92A is suctioned by the suction pump 96 to achieve negative pressure.

It means that the pressure buffer room 213 having the flexible film 124 according to the present embodiment serves as a pressure recovery delay mechanism that delays the recovery of the pressure in the suction cap member 92A after the pressure in the suction cap member 92A is lowered by being suctioned by the suction pump 96 and then released to the atmosphere by operating the switch unit 98 to open the release port 161 of the suction cap member 92A to the atmosphere.

Fifth Embodiment

Figure 14A:
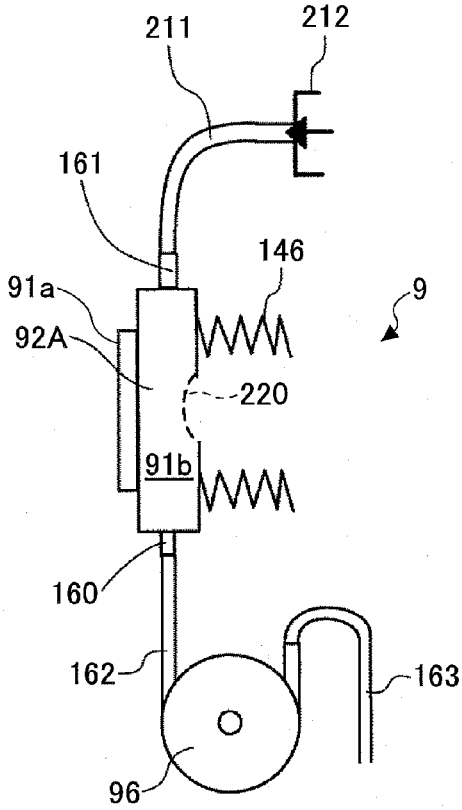
FIGS. 14A and 14B are drawings for explaining the operation of the maintenance and recovery mechanism of another embodiment.
Figure 14B:
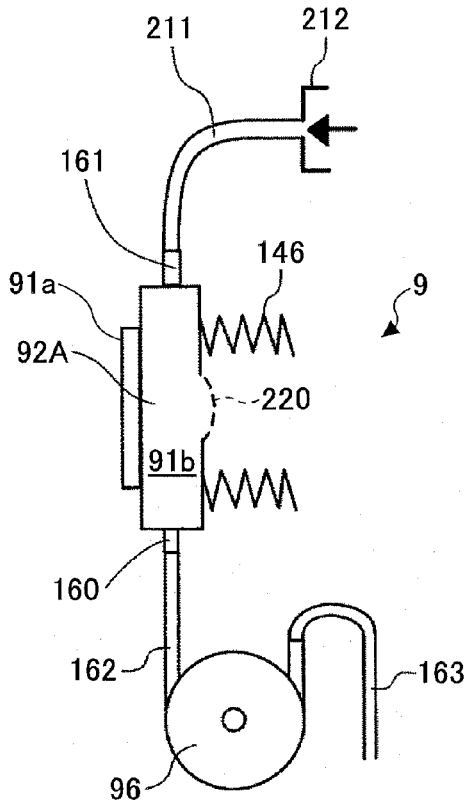

Next, the structure of the image forming apparatus 1 according to the fifth embodiment will be explained referring to FIGS. 14A and 14B. FIGS. 14A and 14B are drawings for explaining the operation of the maintenance and recovery mechanism 9 of the present embodiment.

In this embodiment, a flexible film 220 may be provided as a part of the sidewall opposing to the sidewall that faces the nozzle surface 124. In this embodiment, since the flexible film 220 contacts the ink (liquid), the flexible film 220 may be composed of a material having a resistance against the ink even when repeatedly contacting the ink.

When the suction pump 96 is driven to suction the suction cap member 92A to discharge the liquid in the nozzles 124*b* of the nozzle surface 124 while the switch valve 212 is closed, inside the suction cap member 92A is suctioned to achieve negative pressure. Consequently, the flexible material 220 forms a concavity inside the suction cap member 92A as shown in FIG. 14A.

When the operation of the suction pump 96 is terminated and switch valve 212 is opened as shown in FIG. 14B, air flows into the suction cap member 92A. When there is no release way for the air and the pressure in the suction cap member 92A becomes higher, the flexible material 220 of the suction cap member 92A protrudes outward to expand the suction cap member 92A. It means that the volume of the closed area including the suction cap member 92A increases to delay or absorb the pressure recovery. Therefore, flowing out of the ink from the switch valve 212 because of the increase of the pressure in the suction cap member 92A cap can be prevented.

As described above, with this structure, the recovery of the pressure in the suction cap member 92A can be delayed and the flowing out of the ink from the release port 161 can be prevented without increasing the number of parts and the size of the maintenance and recovery mechanism 9 can be maintained smaller. Further, the flexible film 220 may be provided at the part on the above mentioned sidewall between the pressing springs 146. With this structure, when the suction cap member 92A expands, the flexible film 220 expands into a dead space between the pressing springs 146. Thus, the flexible film 220 does not bother any other parts even when it expands outward.

With this structure, the recovery of the pressure in the suction cap member 92A can be delayed and the flowing out of the ink from the release port 161 can be prevented.

It means that the flexible film 220 according to the present embodiment provided in the suction cap member 92A serves as a pressure recovery delay mechanism that delays the recovery of the pressure in the suction cap member 92A after the pressure in the suction cap member 92A is lowered by being suctioned by the suction pump 96 and then released to the atmosphere by operating the switch unit 98 to open the release port 161 of the suction cap member 92A to the atmosphere.

Sixth Embodiment

Figure 15A:
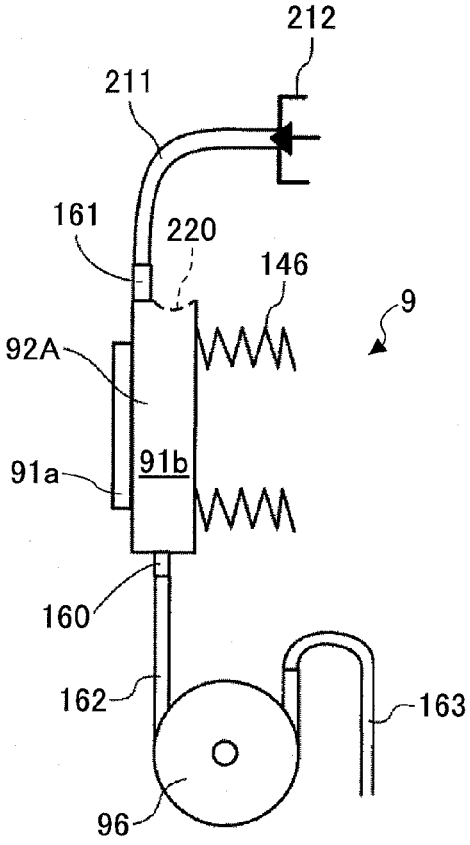
FIGS. 15A and 15B are drawings for explaining the operation of the maintenance and recovery mechanism of another embodiment.
Figure 15B:
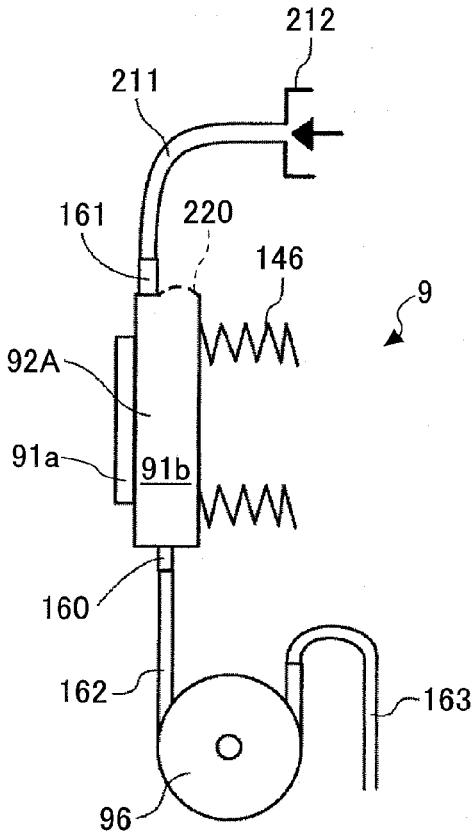

Next, the structure of the image forming apparatus 1 according to the sixth embodiment will be explained referring to FIGS. 15A and 15B. FIGS. 15A and 15B are drawings for explaining the operation of the maintenance and recovery mechanism 9 of the present embodiment.

In this embodiment, the flexible film 220 similar to that explained in the fifth embodiment is provided as a part of the top wall where the release port 161 is provided of the suction cap member 92A.

By providing the flexible film 220 at the top wall of the suction cap member 92A, even when the flexible film 220 is spoiled or broken, as the ink remains at the bottom of the suction cap member 92A, the ink does not leak from the suction cap member 92A so that the contamination in the apparatus can be prevented. Further, by providing the flexible film 220 at the top wall of the suction cap member 92A, the flexible film 220 does not usually contact the ink as the ink remains at the bottom of the suction cap member 92A.

The flexible films 220 may be provided at plural places of the walls of the suction cap member 92A. With this structure, the pressure recovery delaying effect can be increased.

It means that the flexible film 220 according to the present embodiment provided in the suction cap member 92A serves as a pressure recovery delay mechanism that delays the recovery of the pressure in the suction cap member 92A after the pressure in the suction cap member 92A is lowered by being suctioned by the suction pump 96 and then released to the atmosphere by operating the switch unit 98 to open the release port 161 of the suction cap member 92A to the atmosphere.

Seventh Embodiment

Figure 16A:
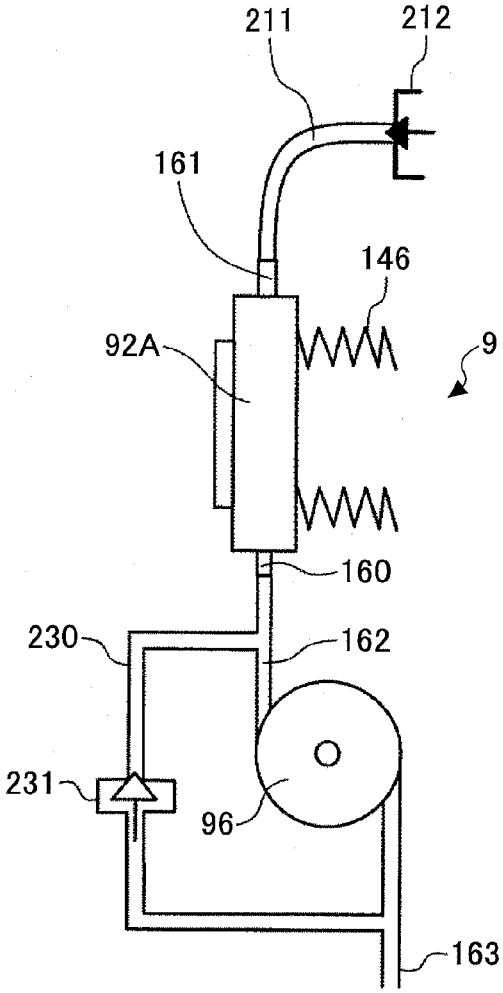
FIGS. 16A and 16B are drawings for explaining the operation of the maintenance and recovery mechanism of another embodiment.
Figure 16B:
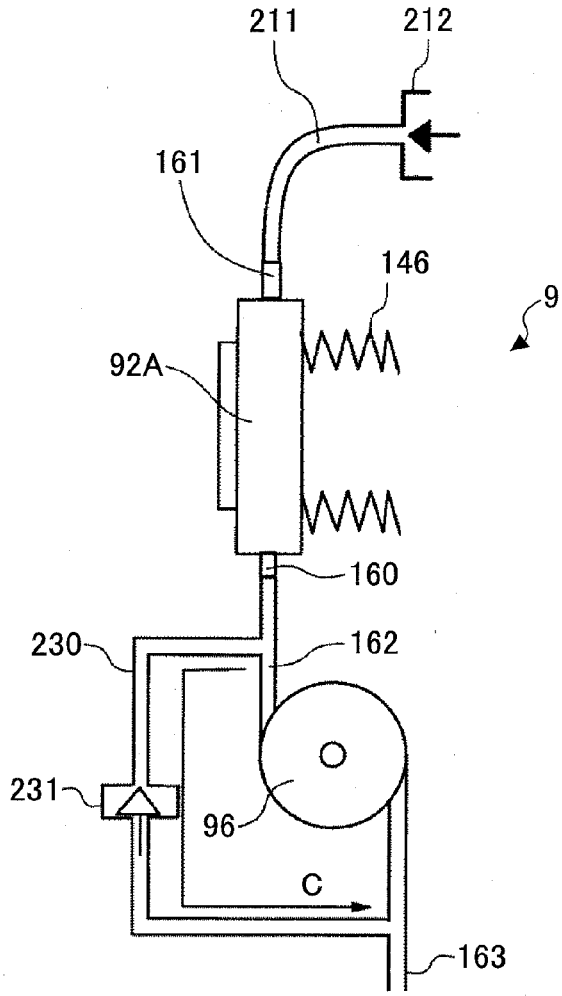

Next, the structure of the image forming apparatus 1 according to the seventh embodiment will be explained referring to FIGS. 16A and 16B. FIGS. 16A and 16B are drawings for explaining the operation of the maintenance and recovery mechanism 9 of the present embodiment.

In this embodiment, the maintenance and recovery mechanism 9 includes a bypass channel 230 that is connected to the suction port 160 of the suction cap member 92A and to the waste channel 163 and bypasses the suction pump 96, and a second switch valve 231 provided in the middle of the bypass channel 230. The second switch valve 231 selects the route from the suction cap member 92A to the waste tank 97, via the suction pump 96 or the bypass channel 231 by opening and closing operations of its valve body. Concretely, when the second switch valve 231 is closed, the flow from the suction cap member 92A passes through the suction pump 96; while the second switch valve 231 is opened, the flow from suction cap member 92A passes through the bypass channel 230.

When the suction pump 96 is driven to suction the suction cap member 92A to discharge the liquid in the nozzles 124*b* of the nozzle surface 124 while the switch valve 212 and the second switch valve 231 are closed, the suction cap member 92A is suctioned to achieve negative pressure as shown in FIG. 16A. At this time, as the second switch valve 231 is closed, the waste liquid discharged to the suction cap member 92A is discharged to the waste tank 97 via the suction pump 96 and the waste channel 163.

Thereafter, while the operation of the suction pump 96 is terminated, the switch valve 212 is opened as shown in FIG. 16B. In this embodiment, the second switch valve 231 is opened at the substantially same time as the switch valve 212 is opened. With this operation, the air having flowed into the suction cap member 92A from outside via the switch valve 212 flows through the bypass channel 230 bypassing the suction pump 96 as shown by an arrow C to the waste tank 97. It means that when the air has flowed into the suction cap member 92A from the switch valve 212, the release channel 211, the release port 161, and the suction cap member 92A does not become a closed space and there is an airway. Therefore, the compression of the air and the pressure overshoot can be prevented so that ink do not flow out from the switch valve 212.

The image forming apparatus 1 of the present embodiment includes a bypass channel that is provided to be in communication with the suction port of the cap member and bypasses the suction unit to be opened to the air and a block unit that changes the flow from the suction port of the cap member between a direction toward the suction unit and a direction toward the bypass channel.

As described above, with this structure, the compression of the air in the suction cap member 92A can be prevented and therefore the flowing out of the ink from the release port 161 can be prevented.

Further, according to the present embodiment, at least a part of the waste tank 97 may be open to the atmosphere, or a part of the waste tank 97 may be composed of a flexible material so that the waste tank 97 can expand to absorb the pressure change in the waste tank 97 when the air has flowed. Further, when the waste tank 97 has an enough space, the volume of the closed space formed between the switch valve 212 and the waste tank 97 can be increased. In such a case, the influence of the pressure overshoot can be reduced. Therefore, when the waste tank 97 has enough space, it is unnecessary to open the waste tank 97 or provide a flexible film in the waste tank 97. The second switch valve 231 may be provided at the connecting part of the suction channel 162 and the bypass channel 230.

Eighth Embodiment

Next, the structure of the image forming apparatus 1 according to the eighth embodiment will be explained referring to FIGS. 17A and 17B. FIGS. 17A and 17B are drawings for explaining the operation of the suction pump 96 of this embodiment.

The suction pump 96 of this embodiment may be a tube pump including a housing 234, a rotating member 236, an elastic tube 237 provided along the outer periphery of the rotating member 236 and housed in the housing 234, and rollers 235A and 235B provided at the outer periphery of the rotating member 236 between the rotating member 236 and the elastic tube 237. There is a space 233 at the bottom of the rotating member 236 within the housing 234. As for this type of the suction pump 96, by rotating the rotating member 236 while pressing the elastic tube 237 with the rollers 235A and 235B, flow occurs in the elastic tube 237. When the rollers 235A and 235B press the elastic tube 237 as shown in FIG. 17A, the elastic tube 237 is closed by the rollers 235A and 235B. When, on the other hand, the rollers 235A and 235B move to the bottom of the rotating member 236 as shown in FIG. 17B, the elastic tube 237 is opened.

Figure 17A:
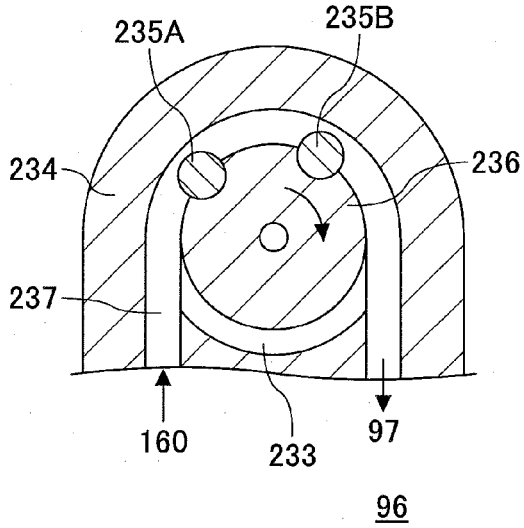
FIGS. 17A and 17B are drawings for explaining the operation of the suction pump of another embodiment.
Figure 17B:
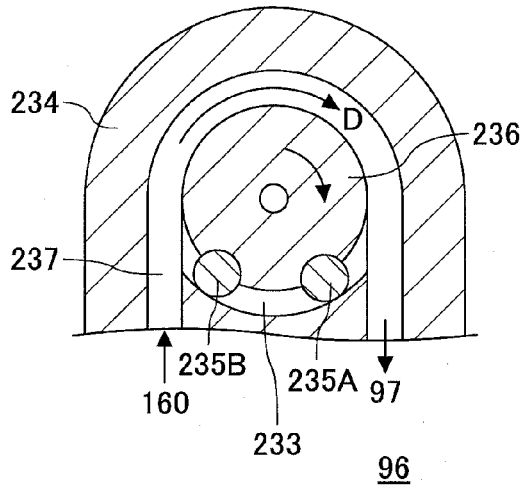

When the suction pump 96 suctions the suction cap member 92A, the rotating member 236 with the rollers 235A and 235B is rotated by a driver such as a stepping motor or the like capable of adjusting the rotation angle of the rotating member 236 to alternately take positions shown in FIGS. 17A and 17B.

In this embodiment, before opening the switch valve 212, the rotation angle of the rotating member 236 is controlled to be where the rollers 235A and 235B are positioned in the space 233 so that the elastic tube 237 is opened. Under such a state, when the switch valve 212 is opened, the air having flowed into the suction cap member 92A moves as shown by an arrow D through the suction pump 96 to the waste tank 97. With this structure, the air having flowed into the suction cap member 92A does not remain in the suction cap member 92A. Therefore, the pressure overshoot does not occur in the suction cap member 92A so as to prevent flow out of the ink from the switch valve 212.

The image forming apparatus 1 of the present embodiment has the following structure. The suction unit is a tube pump and the tube is not pressed by the roller when the switch unit opens the release port to the air.

As described above, with this structure, the compression of the air in the suction cap member 92A can be prevented and therefore the flowing out of the ink from the release port 161 can be prevented.

Ninth Embodiment

Figure 18A:
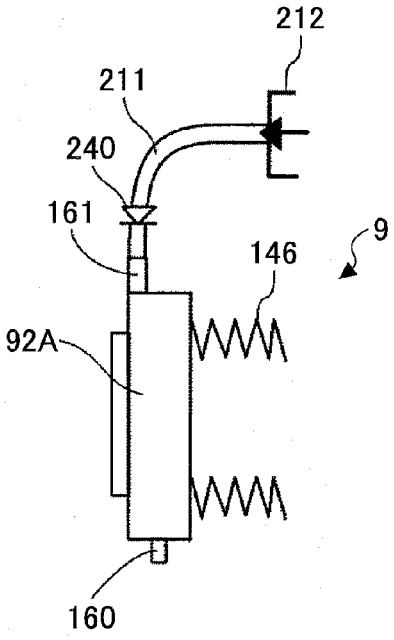
FIGS. 18A and 18B are drawings for explaining the operation of the maintenance and recovery mechanism of another embodiment.
Figure 18B:
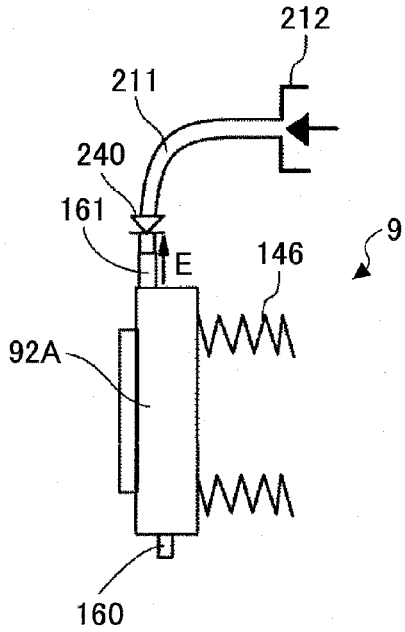

Next, the structure of the image forming apparatus 1 according to the ninth embodiment will be explained referring to FIGS. 18A and 18B. FIGS. 18A and 18B are drawings for explaining the operation of the maintenance and recovery mechanism 9 of the present embodiment.

In this embodiment, the maintenance and recovery mechanism 9 may further include a check valve 240 between the switch valve 212 and the release port 161 of the suction cap member 92A. The check valve 240 only permits the flow in the direction from the switch valve 212 to the suction cap member 92A.

With this structure, when the suction pump 96 is driven to suction the suction cap member 92A to discharge the liquid in the nozzles 124*b* of the nozzle surface 124 while the switch valve 212 is closed as shown in FIG. 18A, pressure inside the suction cap member 92A becomes negative. After that, when the operation of the suction pump 96 is terminated and the switch valve 212 is opened as shown in FIG. 18B, the air flows into the suction cap member 92A. At this time, even when the pressure overshoot occurs in the suction cap member 92A, the flow in the direction from the release port 161 to the switch valve 212 does not occur because of the check valve 240. Therefore, flow out of the ink from the release port 161 to outside can be prevented.

The image forming apparatus 1 of the present embodiment includes a check valve that only permits flow toward outside provided to be in communication with the release port.

As described above, with this structure, the Flowing out of the ink from the release port 161 can be prevented.

In this embodiment, the air having flowed into the suction cap member 92A remains inside the suction cap member 92A and therefore the pressure in the suction cap member 92A is kept high. However, by driving the suction pump 96, the pressure in the suction cap member 92A can be lowered to atmospheric pressure after this status. With this operation the influence of the pressure in the suction cap member 92A can be removed. However, the suction pump 96 may be driven right after the switch valve 212 is opened in order to reduce the influence of the high pressure in the suction cap member 92A. The check valve 240 may take any structure provided that this can certainly pass the air from the switch valve 212 to the release port 161 of the suction cap member 92A and can prevent the flow from the release port 161 of the suction cap member 92A to the switch valve 212.

Tenth Embodiment

Figure 19A:
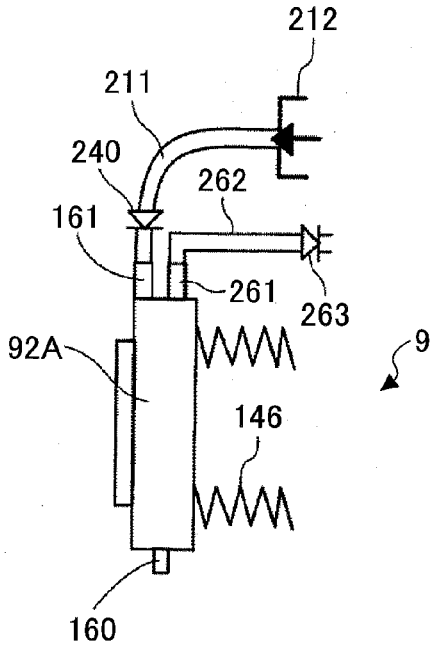
FIGS. 19A and 19B are drawings for explaining the operation of the maintenance and recovery mechanism of another embodiment.
Figure 19B:
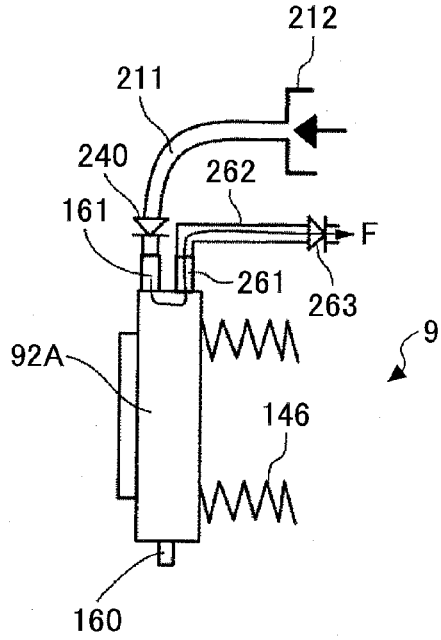

Next, the structure of the image forming apparatus 1 according to the tenth embodiment will be explained referring to FIGS. 19A and 19B. FIGS. 19A and 19B are drawings for explaining the operation of the maintenance and recovery mechanism 9 of the present embodiment.

In this embodiment, the maintenance and recovery mechanism 9 may further include a second release port 261 provided at the suction cap member 92A, a second release channel 262, one end of which is connected to the second release port 261, and a check valve 263 in addition to the structure explained in the ninth embodiment with reference to FIGS. 18A and 18B. The second release channel 262 is connected to the second release port 261 and the check valve 263 is provided in the second release channel 262. The check valve 263 only permits the flow in the direction from the second release port 261 to outside.

With this structure, when the suction pump 96 is driven to suction the suction cap member 92A to discharge the liquid in the nozzles 124*b* of the nozzle surface 124 while the switch valve 212 is closed as shown in FIG. 19A, pressure inside the suction cap member 92A becomes negative. After that, when the operation of the suction pump 96 is terminated and the switch valve 212 is opened as shown in FIG. 19B, the air flows into the suction cap member 92A. At this time, the air having flowed into the suction cap member 92A flows out from the second release port 261 to outside via the second release channel 262 and the check valve 263 as shown by an arrow F. Therefore, the air having flowed into the suction cap member 92A does not remain but flows outside so that the pressure overshoot does not occur and the flowing out of the ink from the release port 161 can be prevented.

In this embodiment, when the second release port 261 is provided at the position contacting the ink in the suction cap member 92A, the ink may flow out from the release port 261 with the air having flowed from the switch valve 212. Therefore, the second release port 261 may be provided at the top of the suction cap member 92A as well as the release port 161.

The image forming apparatus 1 of the present embodiment includes the switch unit that is provided to be in communication with the release port of the cap member to open and close the release port of the cap member to the air and a third port being capable of being open to the air is provided to the cap member.

As described above, with this structure, the compression of the air in the suction cap member 92A can be prevented and therefore the flowing out of the ink from the release port 161 can be prevented.

The image forming apparatus 1 may be any kind of image forming apparatus other than that explained in the above embodiments. For example, the image forming apparatus may be a type where the paper is transferred in a direction inclined to the vertical direction and droplets are discharged in a direction inclined to the horizontal direction. Further, the image forming apparatus 1 may be a line type image forming apparatus.

The present invention is not limited to the specifically disclosed embodiments, and variations and modifications may be made without departing from the scope of the present invention.

The present application is based on Japanese Priority Application No. 2010-262972 filed on Nov. 25, 2010, the entire contents of which are hereby incorporated herein by reference.

What is claimed is:

1. An image forming apparatus comprising:

a recording head that includes a nozzle surface on which a line of nozzles is provided where plural of the nozzles are aligned, each of the plural nozzles discharging a droplet;

a cap member that caps the nozzle surface of the recording head and includes a release port capable of being open to the air and a suction port;

a suction unit that is provided to be in communication with the suction port of the cap member to suction a liquid in the nozzles of the recording head;

a switch unit that opens and closes the release port of the cap member to the air, the switch unit being capable of adjusting the opening amount of the release port to at least a first opening amount and a second opening amount larger than the first opening amount; and a control unit that controls the suction unit and the switch unit so that the liquid in the nozzles of the recording head is suctioned by the suction unit from the suction port, the release port is then opened to the first opening amount to have a predetermined amount of the air flow into the cap member, and the release port is opened to the second opening amount after the predetermined amount of the air flows into the cap member, wherein the switch unit includes a needle valve for opening and closing the release port of the cap member capable of adjusting the opening amount of the release port to the air.

2. The image forming apparatus according to claim 1, wherein the recording head is disposed to discharge droplets in a horizontal direction, or in a direction inclined to the horizontal direction.

3. The image forming apparatus according to claim 1, wherein the recording head is disposed such that the nozzle surface is placed in a vertical direction or in a direction inclined to the vertical direction.

* * * * *